US007159270B2

(12) United States Patent
Genoa et al.

(10) Patent No.: US 7,159,270 B2
(45) Date of Patent: Jan. 9, 2007

(54) VACUUM CLEANER ADAPTERS AND ASSEMBLIES INCLUDING THE SAME

(75) Inventors: Mark Genoa, Melville, NY (US); Scott Genoa, Merrick, NY (US); Joseph Genoa, Boca Raton, FL (US)

(73) Assignee: Nationwide Sales & Service, Inc., West Babylon, NY (US)

( * ) Notice: Subject to any disclaimer, the term of this patent is extended or adjusted under 35 U.S.C. 154(b) by 64 days.

(21) Appl. No.: 11/121,717

(22) Filed: May 3, 2005

(65) Prior Publication Data

US 2006/0174440 A1 Aug. 10, 2006

Related U.S. Application Data

(63) Continuation-in-part of application No. 11/055,209, filed on Feb. 10, 2005.

(51) Int. Cl.
*A47L 5/38* (2006.01)
*A47L 9/24* (2006.01)
*A47L 9/32* (2006.01)

(52) U.S. Cl. ..... 15/314; 15/321; 15/327.1; 15/377; 15/414; 285/7

(58) Field of Classification Search ..... None
See application file for complete search history.

(56) References Cited

U.S. PATENT DOCUMENTS

D264,011 S 4/1982 Genoa
4,385,790 A 5/1983 Genoa
D287,896 S 1/1987 Genoa et al.
4,652,063 A 3/1987 Genoa et al.
4,804,333 A 2/1989 Genoa et al.
4,826,444 A 5/1989 Genoa et al.
4,969,837 A 11/1990 Genoa et al.
5,028,245 A 7/1991 Stein et al.
5,551,731 A * 9/1996 Gray et al. ..... 285/7

* cited by examiner

*Primary Examiner*—David Redding
(74) *Attorney, Agent, or Firm*—Frishauf, Holtz, Goodman & Chick, P.C.

(57) ABSTRACT

Adapter for connecting a vacuum cleaner hose to a canister housing or a handle assembly and hose assemblies including the same. One adapter includes an outer sleeve matable with the canister housing and having electrodes, a hose engagement sleeve arranged at least partially in the outer sleeve and positioning wires of the hose in alignment with the electrodes, and an annealing ring arranged at least partially in the hose engagement sleeve such that a space is provided between the hose engagement sleeve and the annealing ring in which the hose is situated. When the annealing ring is annealed, the wires will be held in contact with the electrodes. Another adapter includes an outer sleeve matable with the canister housing, a hose engagement sleeve arranged at least partially in the outer sleeve and having electrodes, and an annealing ring arranged at least partially in the hose engagement sleeve.

23 Claims, 24 Drawing Sheets

VACUUM CLEANER ADAPTERS AND ASSEMBLIES INCLUDING THE SAME

CROSS-REFERENCE TO RELATED APPLICATION

This application is a continuation-in-part of U.S. patent application Ser. No. 11/055,209 filed Feb. 10, 2005, the specification of which is incorporated by reference herein.

FIELD OF THE INVENTION

The present invention relates generally to various parts for vacuum cleaners, both individually and in combination with other vacuum cleaner parts. More particularly, the present invention relates to vacuum cleaner adapters which interconnect other parts of the vacuum cleaner, for example, a vacuum cleaner canister housing to a hose, a hose to a handle assembly and a handle assembly to a wand assembly or other vacuum cleaner accessory.

The present invention also relates to vacuum cleaner hose assemblies having adapters at each end designed to connect the hose assembly to other parts of the vacuum cleaner, such as the vacuum cleaner canister housing and the handle assembly.

The present invention also relates to vacuum cleaner handle assemblies having an adapter which connects the handle assembly to a wand assembly or other accessory.

BACKGROUND OF THE INVENTION

A vacuum cleaner typically includes a canister housing connected through a hose to a handle assembly which in turn is connected to an electrified power nozzle through a wand assembly. The hose typically includes adapters at its end, one of which is engaged with a port in the canister housing and the other of which is engaged with the handle assembly. Another adapter is often coupled to the handle assembly to enable the handle assembly to engage with the wand assembly leading to the power nozzle or with other electrified vacuum cleaner accessory.

An electrical connection must be provided between the canister housing and the power nozzle or other accessory to provide power thereto. To this end, the adapters, hose and handle assembly all must be provided with an electrical interconnection system and cooperating electrical members to provide a current flow path between the housing and the power nozzle or other accessory.

Often, a vacuum cleaner manufacturer will make unique electrical members for its adapters, hoses and handle assemblies to thereby require a user to purchase those parts from the manufacturer in the event replacement parts are needed. The manufacturer generally charges a premium for its replacement parts.

OBJECTS AND SUMMARY OF THE INVENTION

It is an object of the present invention to provide new and improved vacuum cleaner adapters which interconnect parts of the vacuum cleaner, for example, a vacuum cleaner canister housing to a hose, a hose to a handle assembly and a handle assembly to a wand assembly or other vacuum cleaner accessory, and assemblies including such adapters.

It is another object of the present invention to provide vacuum cleaner assemblies having adapters which enable the assemblies to be used as replacement parts for existing vacuum cleaners.

In order to achieve these objects and others, an adapter in accordance with the invention for connecting a vacuum cleaner canister housing to a vacuum cleaner hose including a pair of wires, includes an outer sleeve adapted to mate with the canister housing and including electrodes through which electricity is transferred from the canister housing to the wires in the hose, a hose engagement sleeve arranged at least partially in the outer sleeve and positioning the wires of the hose in alignment with the electrodes, and an annealing ring arranged at least partially in the hose engagement sleeve such that a space is provided between the hose engagement sleeve and the annealing ring in which the hose is situated. When the annealing ring is annealed, the wires will be held in contact with the electrodes.

The electrodes each include an arcuate portion arranged against an inner surface of the outer sleeve, with each wire being adapted to contact the arcuate portion of a respective electrode. The hose engagement sleeve may include a substantially tubular body having a pair of wire guide notches in which the wires of the hose are positioned.

A hose assembly may be formed including an adapter in any of the constructions described above and an elongate hose including a pair of wires which is terminated at one end by the adapter. The wires are thus positioned in a respective wire guide notch with an exposed part extending outwardly and each exposed part is arranged in contact with a respective electrode, i.e., in contact with the arcuate portion of the respective electrode.

Another adapter for connecting a vacuum cleaner canister housing to a vacuum cleaner hose includes an outer sleeve adapted to mate with the canister housing, a hose engagement sleeve arranged at least partially in the outer sleeve and including electrodes through which electricity is transferred from the canister housing to the wires in the hose, and an annealing ring arranged at least partially in the hose engagement sleeve such that a space is provided between the hose engagement sleeve and the annealing ring in which the hose is situated. When the annealing ring is annealed, the wires will be held in contact with the electrodes.

In this embodiment, the outer sleeve has a substantially tubular body and spring-loaded engagement members arranged thereon for enabling the outer sleeve to be releasably inserted into a port on the canister housing. The outer sleeve includes an inwardly directed lip at the front end which contacts the annealing ring. The hose engagement sleeve has a substantially tubular body and each electrode includes an exposed flat, arcuate portion arranged against an inner surface of the tubular body and a contact portion projecting outward from the tubular body. The arcuate portions of the electrodes provide contact surfaces for the wires of the hose.

In another embodiment, the tubular body includes contact is receiving members each of which covers a forward part of a respective arcuate portion and through which a respective contact portion extend. The arcuate portions are attached at a rear end to the inner surface of the tubular body to provide an anchor region and enable the contact-receiving members and covered part of the electrodes to be inwardly flexible, which is beneficial during assembly of the adapter.

A hose assembly may be formed including this embodiment of an adapter in any of the constructions described above and an elongate hose including a pair of wires which is terminated at one end by the adapter. Each wire is in contact with a respective electrode, i.e., in contact with the arcuate portions thereof.

Another adapter in accordance with the invention is for connecting a handle assembly for a vacuum cleaner to a vacuum cleaner hose including a pair of wires. Such an adapter includes a sleeve having a contour enabling it to be insertable into a cavity defined by the handle assembly. The sleeve includes a substantially tubular body defining a pair of axially extending grooves, a pair of electrodes each extending along a respective groove and having an exposed portion and electrical contact rings arranged around the tubular body and each in electrical engagement with a respective electrode. An annealing ring is arranged in a front end of the sleeve such that a space is provided between the exposed portion of the electrodes and the annealing ring in which the hose is situated. When the annealing ring is annealed, the wires will be held in contact with the electrodes.

In another embodiment, the sleeve includes a first insulator ring arranged between the contact rings and a second insulator ring arranged at a front of the sleeve. The electrodes each include a flat, arcuate portion arranged against an inner surface of the tubular body, an axially extending intermediate portion extending through a passageway defined in part by a respective groove and a contact portion arranged in contact with a respective contact ring. The tubular body includes an annular locking groove adapted to receive a locking finger formed on the handle assembly, or the sleeve ad handle assembly may include another cooperating or unilateral type locking mechanism.

A hose assembly may be formed including this adapter arranged at one end of the hose, and possibly with one of the canister-end hose adapters described above.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
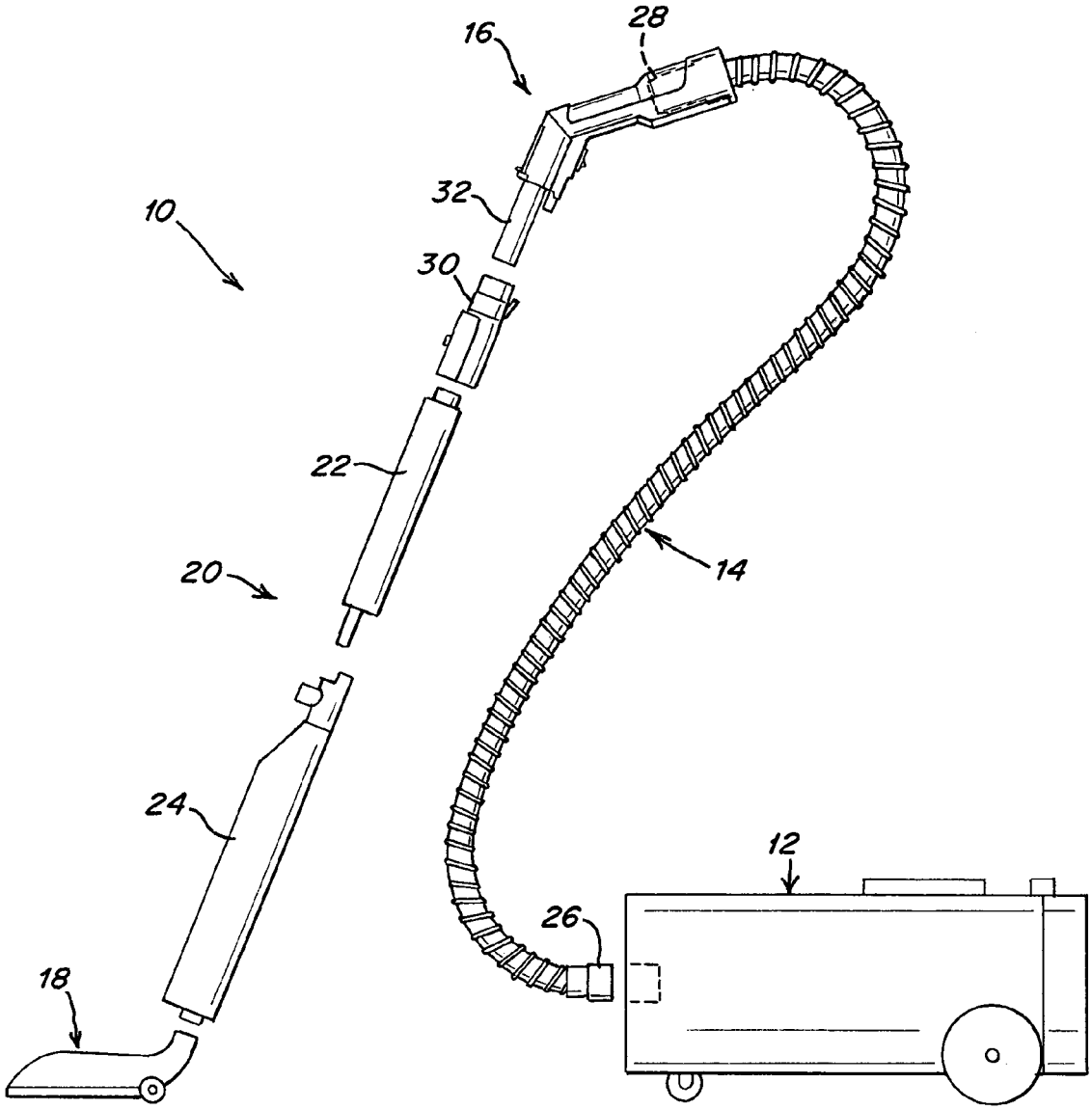
FIG. 1 is an exploded schematic view of a vacuum cleaner in which components according to the present invention can be used.
Figure 2:
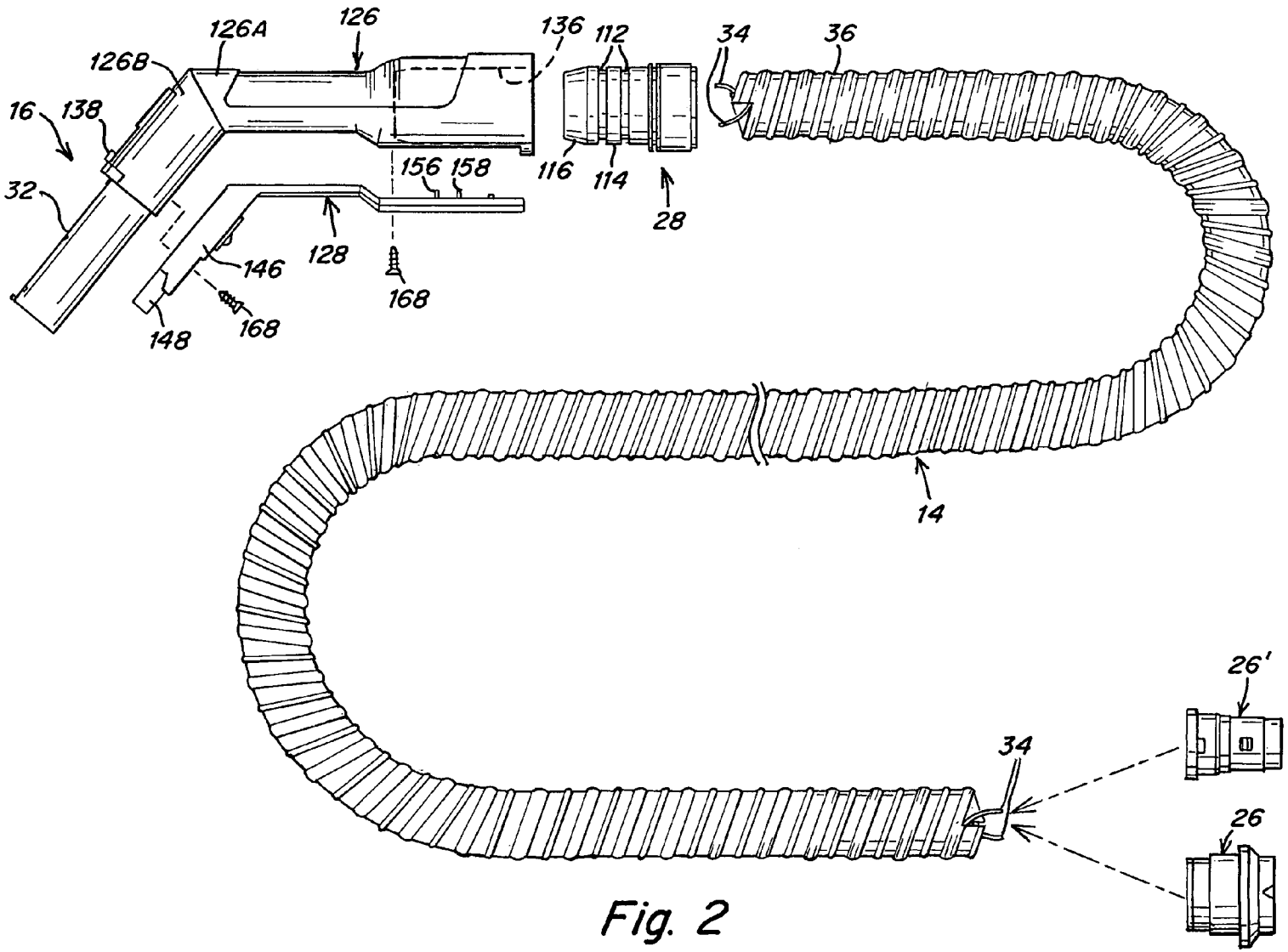
FIG. 2 is an exploded side view of some components of the vacuum cleaner shown in FIG. 1, including a hose, a handle assembly and adapters for connecting the hose to the handle assembly and the hose to a vacuum cleaner canister housing.
Figure 3:
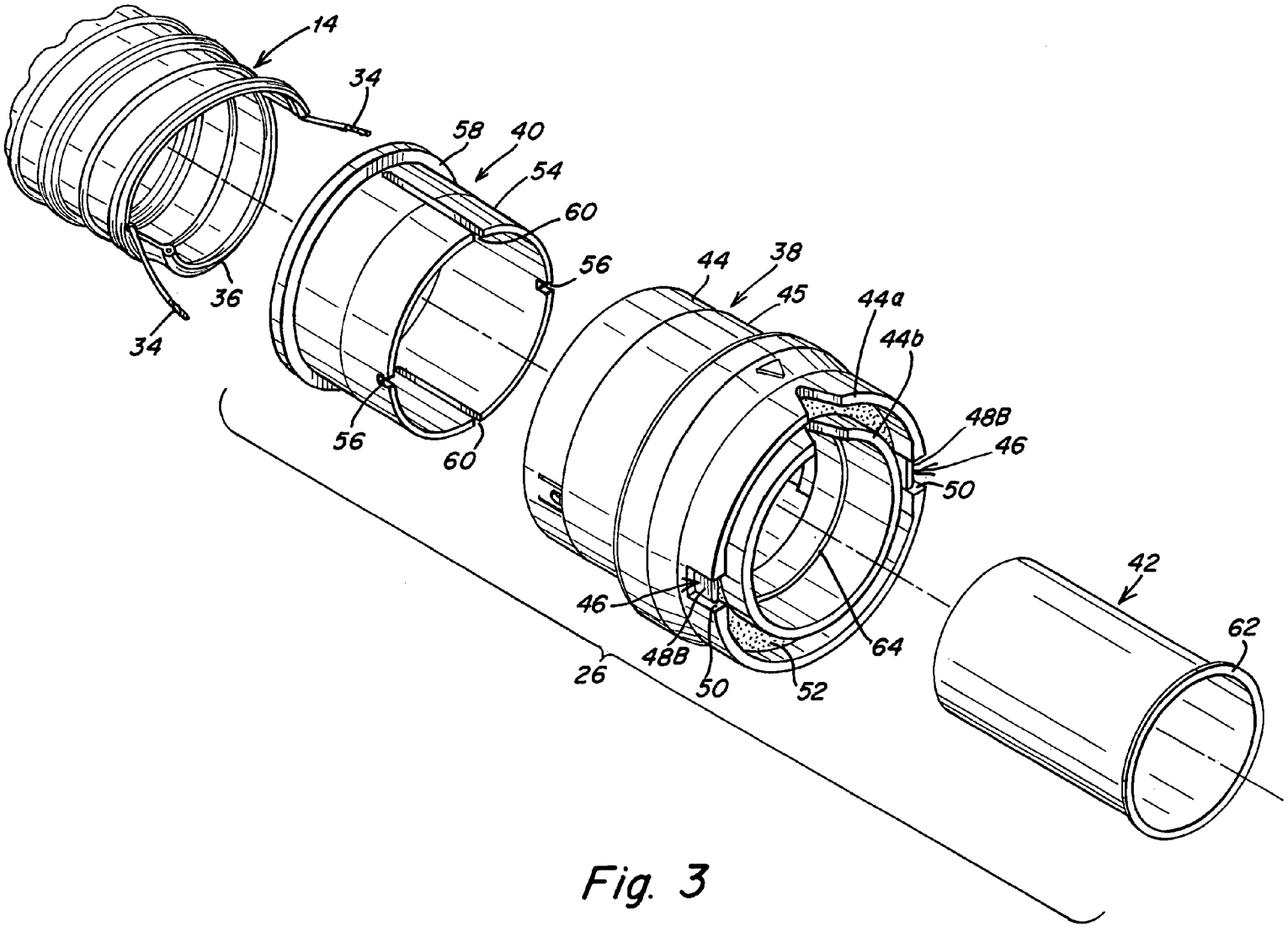
FIG. 3 is an exploded perspective view of a first embodiment of a vacuum hose including a hose adapter in accordance with the invention.

Referring first to FIGS. 1 and 2, a vacuum cleaner in accordance with the invention is designated as 10 and includes certain sub-assemblies that a user can easily assemble for use or disassemble for cleaning, repair or storage. Generally, the vacuum cleaner 10 includes a canister housing 12 connected through a hose 14 to a handle assembly 16. Handle assembly 16 is connected to a power nozzle 18 through a wand assembly 20 having a tubular wand portion 22 and a dust cup assembly 24. Alternatively, wand assembly 20 may be any wand implement used in a vacuum cleaner. Housing 12 typically includes a motor which develops vacuum pressure at an opening or port to draw dust and particulate matter into a dust bag in the housing 12. This vacuum pressure is conveyed through the hose 14 to the power nozzle 18 which is pushed across a surface being vacuumed.

Various adapters are provided to enable the parts of the vacuum cleaner 10 to be easily assembled and disassembled, e.g., for storage, cleaning and repair. Specifically, hose adapter 26 or 26' is connected to the canister end of the hose 14 to releasably connect the hose 14 to the housing 12 and hose adapter 28 is connected to the opposite, handle end of the hose 14 to releasably connect the hose 14 to the handle assembly 16 (see FIG. 2). Adapters 26 and 26' have different constructions and which one is used depends on the construction of the port in the vacuum cleaner housing 12 to which they will mate.

Wand adapter 30 is arranged at a front end of the handle assembly 16 to releasably connect the handle assembly 16 to the wand assembly 20. More specifically, handle assembly 16 includes an outwardly extending metal tube 32 which includes a swaged male end receivable in a female end of the wand adapter 30. A quick release element is provided on the wand adapter 30 for interlocking the handle assembly 16, i.e., the metal tube 32 thereof, and the wand adapter 30, discussed in detail below.

Power nozzle 18 requires electrical power, which is obtained from the housing 12 through various electrical conductors. For example, hose 14 includes a pair of wires 34 wound in a spiral or helix through insulative material 36 forming the hose 14 (see FIG. 2). Adapters 26, 26', 28, 30 therefore must include electrical contacts which contact the wires 34 and conduct electricity to and from the wires 34.

Vacuum cleaner 10 includes several independent parts or assemblies, each of which can be used either in the combination 20 shown in FIG. 1 or 2 or in a vacuum cleaner made of other parts.

For example, a hose assembly is defined by the hose 14 and adapter 26 or 26' at one end and adapter 28 at the opposite end.

Such a hose assembly can be used to interconnect any housing of a vacuum cleaner to any handle assembly provided the vacuum cleaner and handle assembly include mating structure to adapters 26 or 26' and 28. This hose assembly can thus be manufactured and sold as a replacement unit for existing hose assemblies which have become damaged or otherwise require replacement.

Similarly, an assembly can be manufactured and sold to interconnect a vacuum cleaner housing to a wand assembly. Such a hose-handle assembly would include hose 14, adapter 26 or 26' and adapter 28 at the ends of the hose 14 and handle assembly 16 optionally with adapter 30. The requirements for use of such a hose-handle assembly would be that the vacuum cleaner housing includes mating structure for adapter 26 or 26' and the wand assembly includes mating structure for the adapter 30 (when adapter 30 is present). If adapter 30 is not present, then the wand assembly would need to include structure matable with the metal tube 32 of the handle assembly 16.

The foregoing two combinations of parts of the vacuum cleaner 10 described herein to form assemblies in accordance with the invention are not limiting and other combinations of connected parts are also possible and envisioned as separate components and inventions in accordance with the invention.

Each of the adapters 26, 26', 28, 30 will now be described.

Adapter 26, used to connect the canister housing 12 to the vacuum cleaner hose 14, is shown in FIGS. 3–9 and comprises an outer sleeve 38, a hose engagement sleeve 40 insertable into one axial end of the outer sleeve 38 (the rear end as used herein), and an annealing ring 42 insertable into the other axial end of the outer sleeve 38 (the front end as used herein).

Outer sleeve 38 has a substantially tubular body 44 made of a dielectric material with an outer surface defining a rearward facing step and an inner surface defining a rearward-facing step. The front end of the outer sleeve 38 is provided with a form enabling it to be inserted into the port on the canister housing 12, e.g., a pair of concentric rings 44*a*, 44*b*, each having a V-shaped notch. The form of the front end of the outer sleeve 38 is compatible with the form of existing manufacturers=hose assemblies so that a hose assembly with hose 14 and adapter 26 can be used as a replacement part instead of the manufacturer=s hose assembly.

Figure 5:
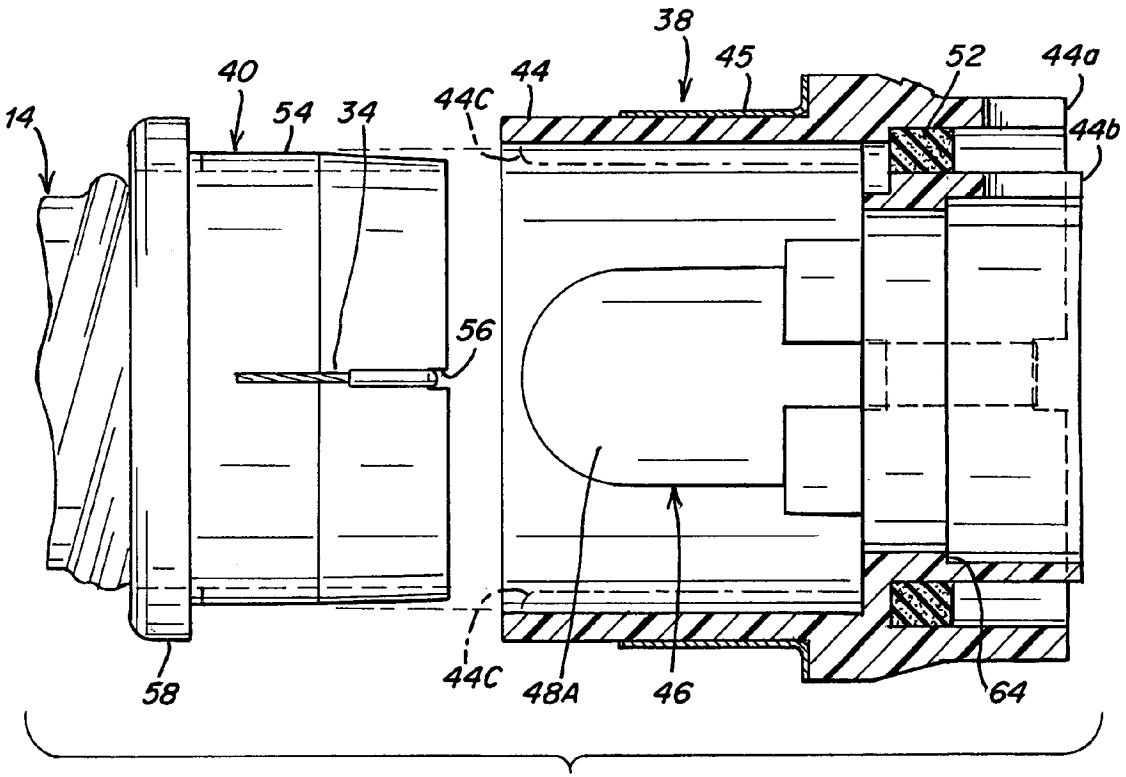
FIG. 5 is an exploded cross-sectional view taken along the line 5—5 of FIG. 4 of the main housing, hose engagement part and hose prior to insertion of the hose engagement part having the hose engaging therewith into the main housing.
Figure 4:
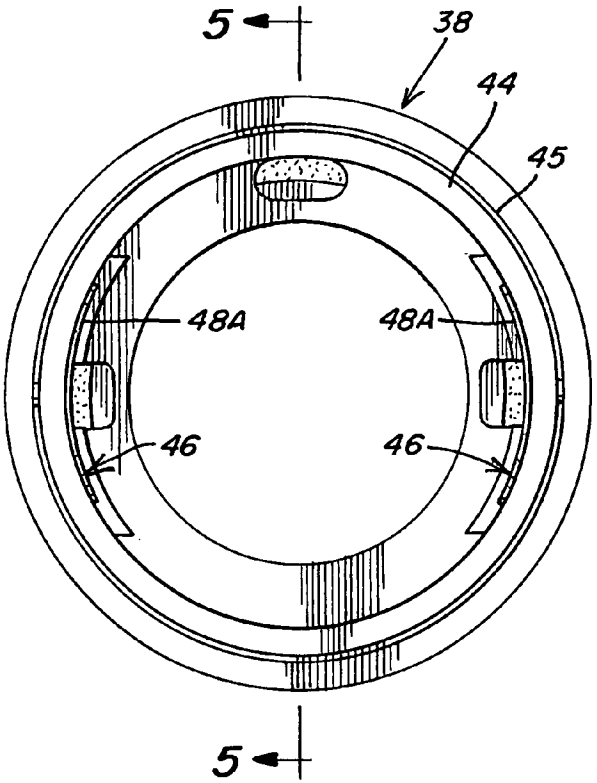
FIG. 4 is an end elevational view of the main housing of the adapter shown in FIG. 3.
Figure 6:
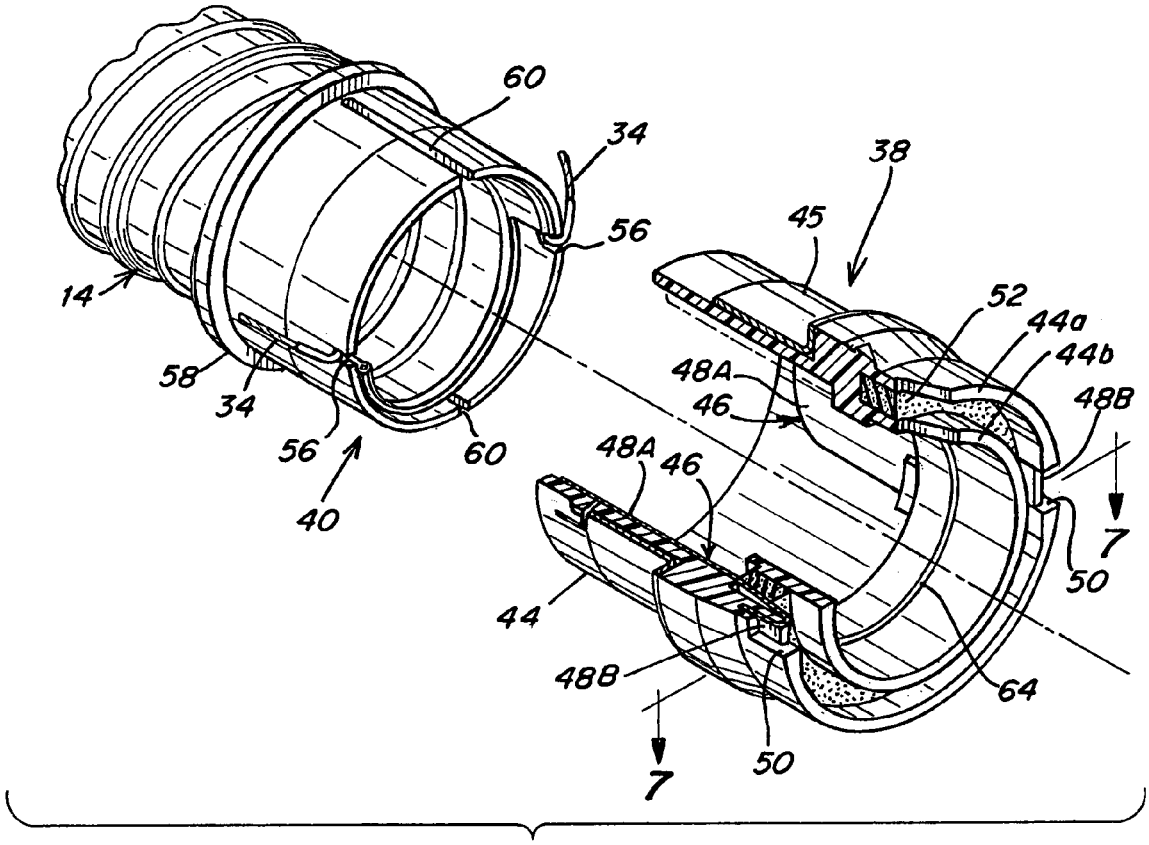
FIG. 6 is an exploded perspective view of the assembly shown in FIG. 5.
Figure 7:
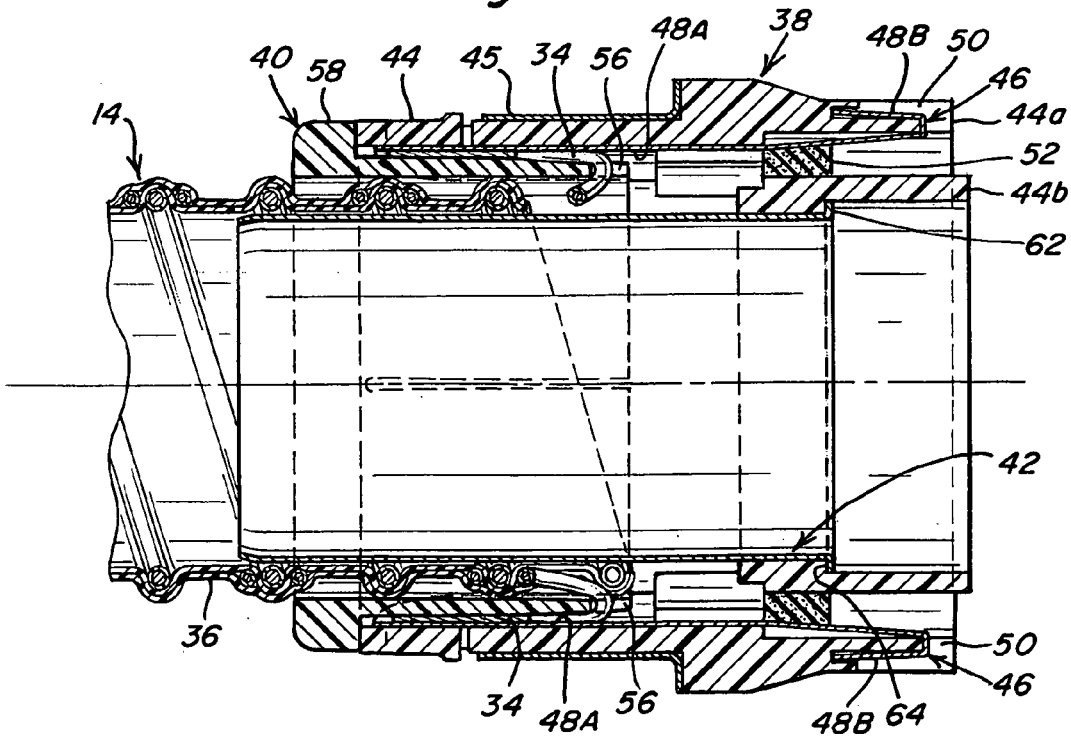
FIG. 7 is a cross-sectional view taken along the line 7—7 of FIG. 6 of the main housing, hose engagement part having the hose engaging therewith and annealing ring.
Figure 8:
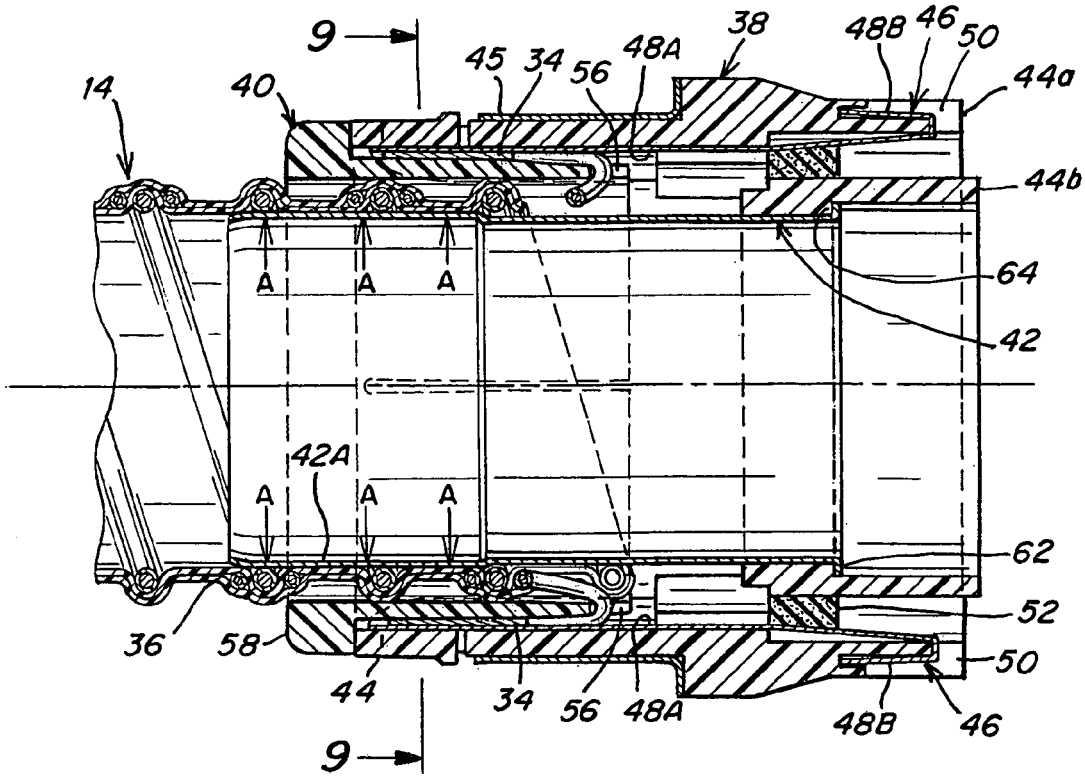
FIG. 8 is a cross-sectional side view of the final assembly of the hose adapter terminating a hose in accordance with the invention.

The outer sleeve 38 also includes a pair of electrodes 46 each having an exposed flat, arcuate portion 48A arranged against the inner surface of the tubular body 44 rearward of the step (see FIGS. 4 and 5). Electrodes 46 also include contact portions 48B arranged in notches 50 formed on the outer ring 44*a* and which are electrically connectable to contacts in the canister housing 12 when adapter 26 is inserted into the port on the canister housing 12. A cushion 52 is arranged between the rings 44*a*, 44*b*. An optional reinforcing ring 45 is arranged around the tubular body 44.

Hose engagement sleeve 40 has a substantially tubular body 54 made of dielectric material with a pair of wire positioning notches 56 formed at the front edge. Wires 34 of the hose 14 are positioned in the notches 56 during assembly of the adapter 26. The tubular body 54 also includes a outwardly projecting rim 58 at a rear edge which serves as a stop to limit insertion of the hose engagement sleeve 40 into the rear end of the outer sleeve 38 and a pair of opposed axial slots 60. The axial slots 60 are designed to allow the parts of the tubular body 54 formed between the slots 60 to be urged together, which is necessary during assembly of the adapter 26. Slots 60 also aid in positioning the hose engagement sleeve 40 in the proper rotational position relative to the exposed portions 48A of the electrodes 46.

Annealing ring 42 is substantially cylindrical and includes a small lip 62 at a front edge. Annealing ring 42 is made of a material capable of being annealed or deformed, the purpose of which is explained below.

To assemble adapter 26 in connection with hose 14 to form a hose assembly, one end of the hose 14 is cut to provide a free length of the wires 34 and the insulation on this free length of the wires 34 is then cut to expose the electrically conductive material thereof. The hose 14 is then inserted through the hose engagement sleeve 40 and the wires 34 are bent outward and positioned in connection with hose engagement sleeve 40, each in a respective one of the wire guide notches 56 such that the exposed conductive part is situated outward of the hose engagement sleeve 40 (see FIGS. 5 and 6). This sub-assembly is then inserted into the rear end of the outer sleeve 38 such that the exposed conductive part of each wire 34 comes into contact with an arcuate portion 48A of a respective electrode 46 (see FIG. 7). This may be facilitated by forming orientation ribs 44C (shown in phantom lines in FIG. 5) on the inner surface of the tubular body 44 which slide into the axial slots 60 on the hose engagement sleeve 40. Insertion continues, for example, until the rim 58 engages the rear edge of the body 44 to arrive at the construction shown in FIG. 7. Annealing ring 42 is then inserted into the front end of the outer sleeve 38 until the lip 62 contacts a circumferential lip 64 formed on the inner surface of the body 44 (see FIG. 8). The assembly is then inserted into an annealing device which applies a force outward from an interior of the annealing ring 42 (in the direction of arrows A in FIG. 8) to cause a rear portion of the annealing ring 42 to expand and press the hose 14 against the hose engagement sleeve 40. The expanded rear portion is designated 42A and has an expanded radius $R_E$ while the original radius of the annealing ring 42 is designated R (see FIGS. 8 and 9).

Figure 9:
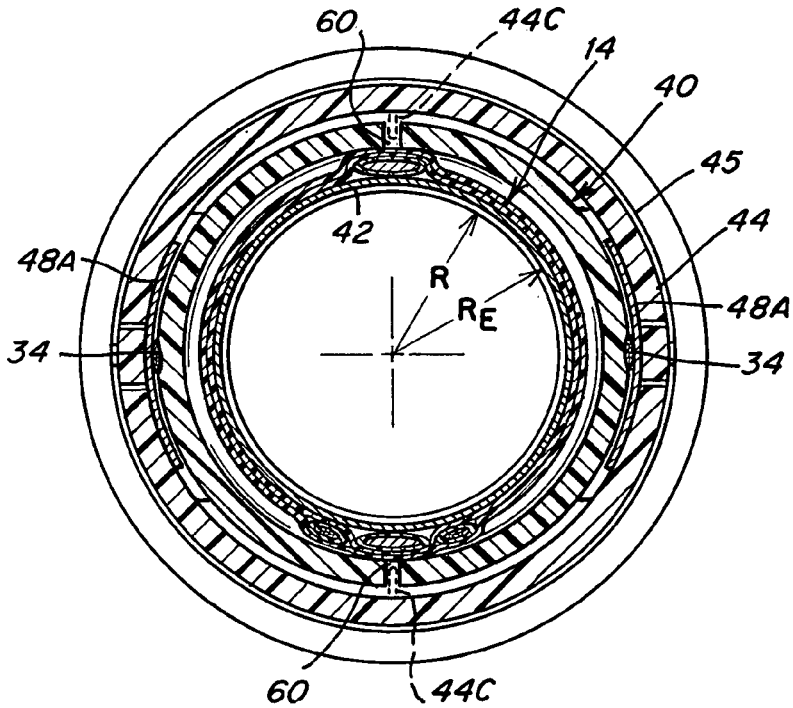
FIG. 9 is a cross-sectional end view taken along the line 9—9 of FIG. 8.

The hose 14 is thereby secured to the adapter 26 and the exposed conductive parts of the wires 34 are firmly pressed against the arcuate portions 48A of the electrodes 46 (see FIG. 9). Thus, electrical connection between the wires 34 in the hose 14 and the electrodes 46 is provided. Power to operate the power nozzle 18 can therefore be provided from the housing 12 to and through the hose 14 via the connection between the contact portions 48B of the electrodes 46 and contacts in the housing 12 and the connection between the arcuate portions 48A of the electrodes 46 and the wires 34.

Adapter 26' is shown in FIGS. 10–15 and comprises an outer sleeve 66, a hose engagement sleeve 68 insertable into one axial end of the outer sleeve 66 (the rear end as used herein), and an annealing ring 70 insertable into the other axial end of the outer sleeve 66 (the front end as used herein).

Figure 10:
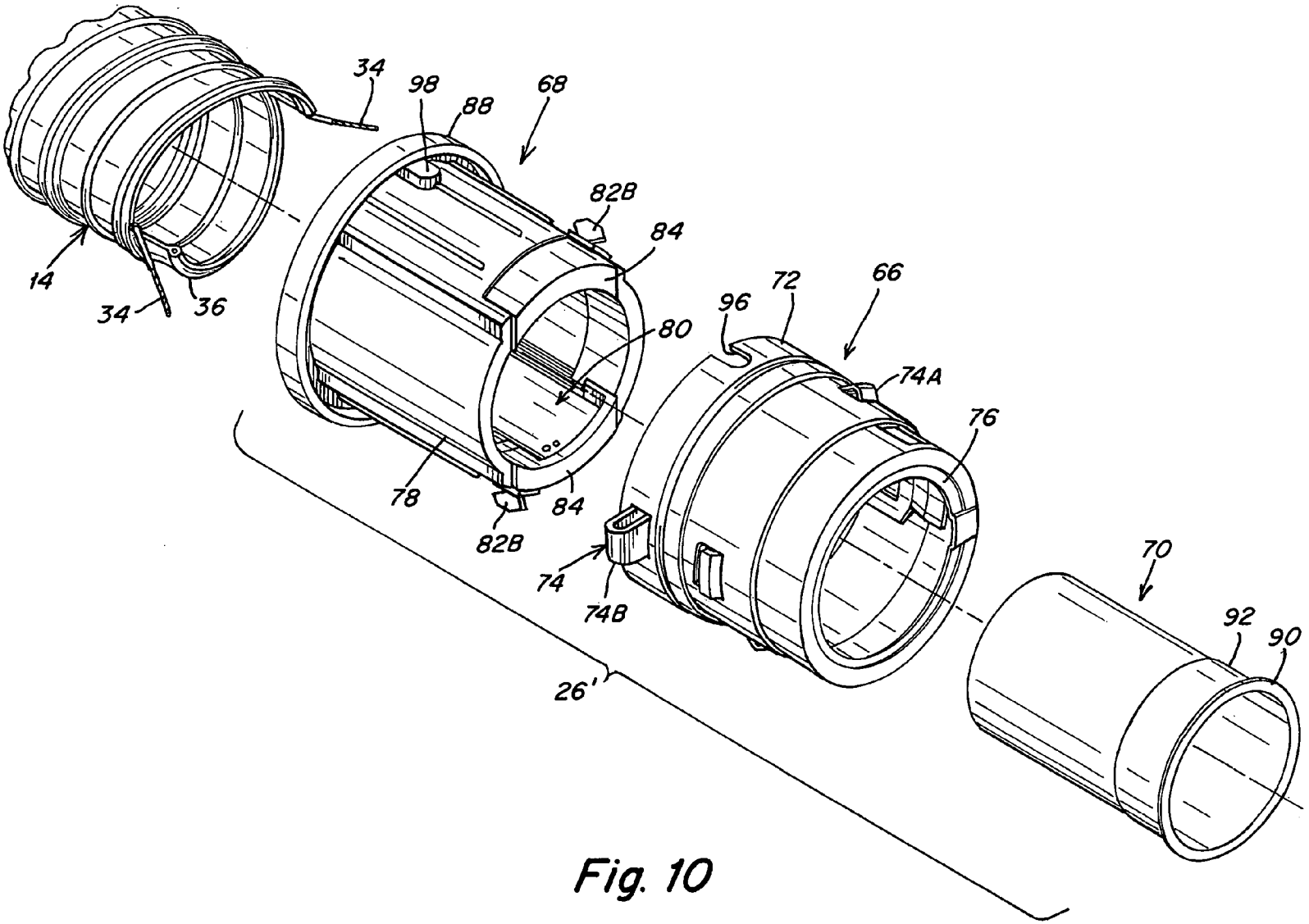
FIG. 10 is an exploded perspective view of a second embodiment of a vacuum hose including a hose adapter in accordance with the invention.

Outer sleeve 66 has a substantially tubular body 72 made of metal and having a form enabling it to be releasably inserted into the port on the canister housing 12, including a pair of spring-loaded engagement members 74 (see FIG. 10). The form of the front end of the outer sleeve 66 is compatible with the form of existing manufacturers=hose assemblies so that a hose assembly with hose 14 and adapter 26' can be used as a replacement part instead of the manufacturer=s hose assembly.

The outer sleeve 66 also includes an inwardly directed lip 76 at the front end which serves as a stop to limit insertion of the annealing ring 70 into the outer sleeve 66.

Spring-loaded engagement members 74 enable the adapter 26' to be removably connected to the canister housing 12. Specifically, members 74 are biased outward and have an engagement portion 74A which interacts with the canister housing 12 to prevent separation of the hose 14 from the canister housing 12 merely by pulling the hose 14 outward. However, members 74 also have an actuating portion 74B which is exposed outside of the canister housing 12 and can be depressed inward to cause engagement portions 74A to be urged inward and allow the hose 14 to then be pulled outward from the housing 12.

Figure 11:
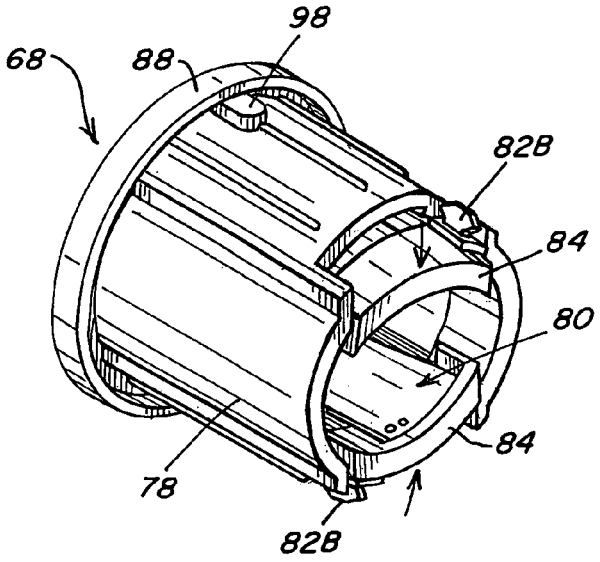
FIG. 11 is a perspective view an insulated hose engagement sleeve of the adapter shown in FIG. 10.
Figure 12:
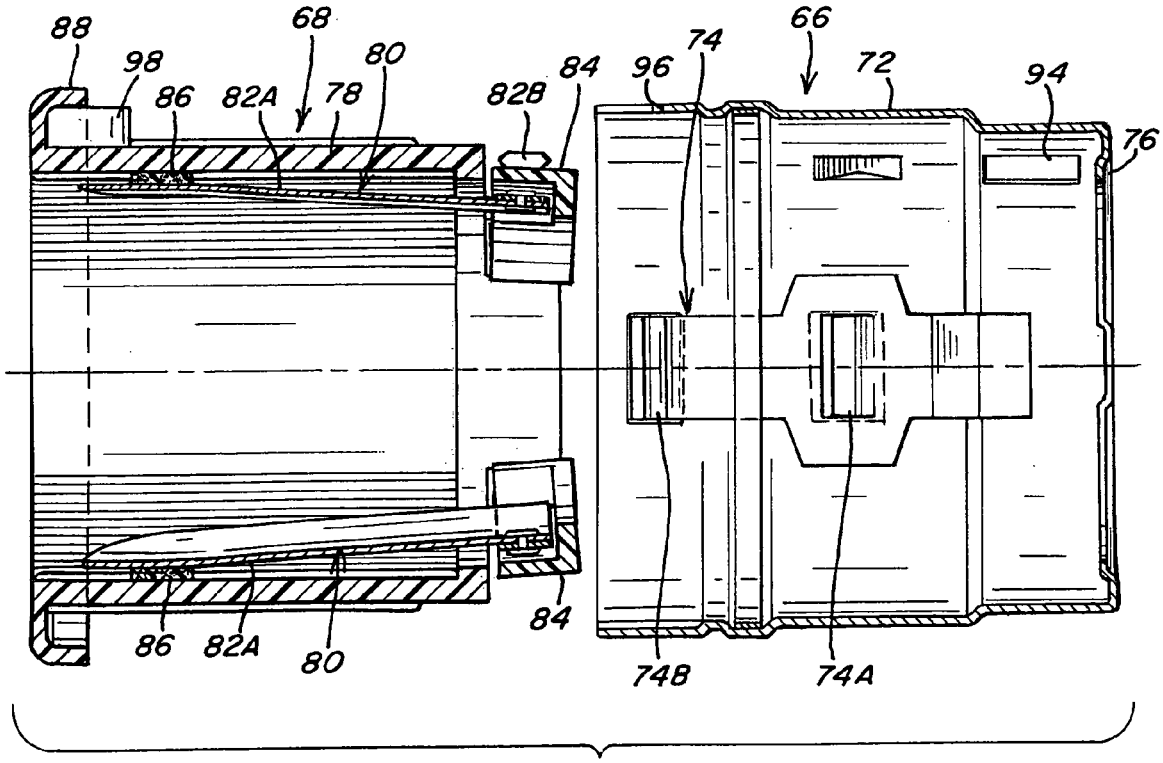
FIG. 12 is an exploded cross-sectional side view of the hose engagement sleeve and outer sleeve showing the hose engagement sleeve being inserted into the outer sleeve.
Figure 14:
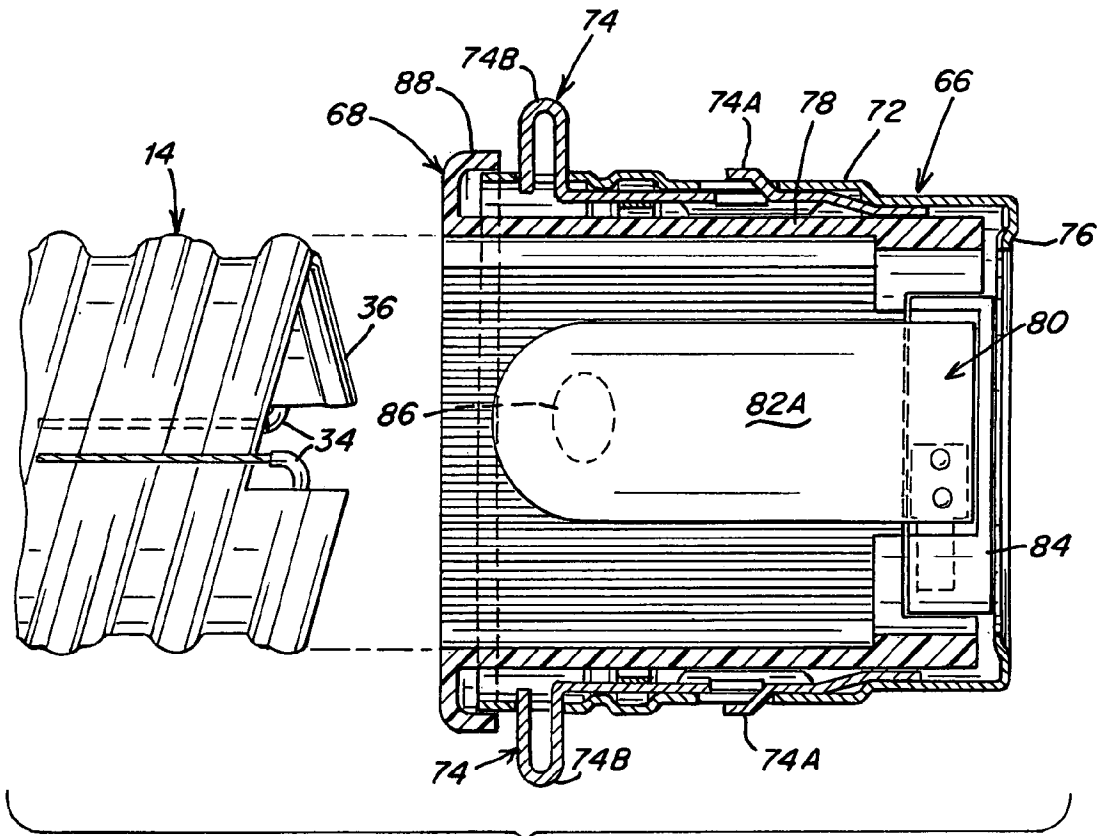
FIG. 14 is an exploded cross-sectional view taken along the line 14—14 of FIG. 13 of the hose engagement sleeve, outer sleeve and hose prior to insertion of the hose into the hose engagement sleeve.
Figure 13:
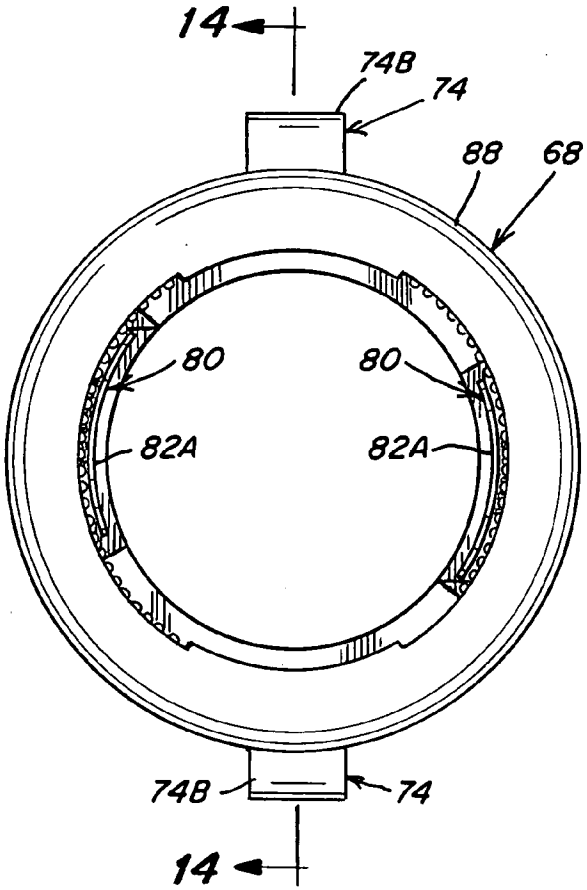
FIG. 13 is an end elevational view of an assembly of the hose engagement sleeve and outer sleeve.

Hose engagement sleeve 68 has a substantially tubular body 78 made of dielectric material and a pair of electrodes 80 each having an exposed flat, arcuate portion 82A arranged against an inner surface of the tubular body 78 and a contact portion 82B projecting outward from the tubular body 78 (see FIGS. 10 and 11). Contact portions 82B are designed to be electrically connectable to contacts in the canister housing 12 when adapter 26' is inserted into the port on the canister housing 12. Arcuate portions 82A and contact portions 82B may be integrally formed or may be formed separately and connected together, e.g., by rivets.

Tubular body 78 includes contact-receiving members 84 which cover a forward part of the arcuate portions 82A and through which the contact portions 82B extend. Arcuate portions 82A of the electrodes 80 are attached at a rear end to the inner surface of the tubular body 78, e.g., via application of epoxy or adhesive to serve as an anchor region 86 (see FIGS. 12–14). As such, the contact-receiving members 84 and contact portions 82B are inwardly flexible, for the purpose of enabling the hose engagement sleeve 68 to be inserted into the outer sleeve 66 in the manner discussed below (see FIG. 12). The tubular body 78 also includes a outwardly projecting rim 88 at a rear edge.

Annealing ring 70 is substantially cylindrical and includes a small lip 90 at a front edge. A plastic ring 92 is arranged over the front end of the annealing ring 70. Annealing ring 70 is made of a material capable of being annealed or deformed, the purpose of which is explained below.

To assemble adapter 26' in connection with hose 14 to form a hose assembly, one end of the hose 14 is cut to provide a free length of the wires 34 and the insulation on this free length of the wires 34 is then cut to expose the electrically conductive material thereof. The exposed wires 34 are bent backward and held alongside the hose 14 (see FIG. 14). The cut end of the hose 14 is then positioned inside hose engagement sleeve 68 with the exposed conductive part of the wires 34 being placed in contact with the arcuate portions 82A of the electrodes 80. This can be facilitated by viewing the position of the arcuate portions 82A through the open front end of the hose engagement sleeve 68.

Either before or after the hose 14 is engaged with hose engagement sleeve 68, the hose engagement sleeve 68 is inserted into the outer sleeve 66. This is achieved by flexing the contact-receiving members 84 inward and inserting the hose engagement sleeve 68 into the rear end of the outer sleeve 66 until the contact portions 82B align with apertures 94 in the outer sleeve 66 and the electrodes 80 and contact-receiving members 84 flex outward. Alignment of the contact portions 82B with the apertures 94 is aided by the placement of a notch 96 at the rear edge of the outer sleeve 66 and a corresponding projection 98 projecting forwardly from the projecting rim 88 (see FIGS. 11 and 12).

Figure 15:
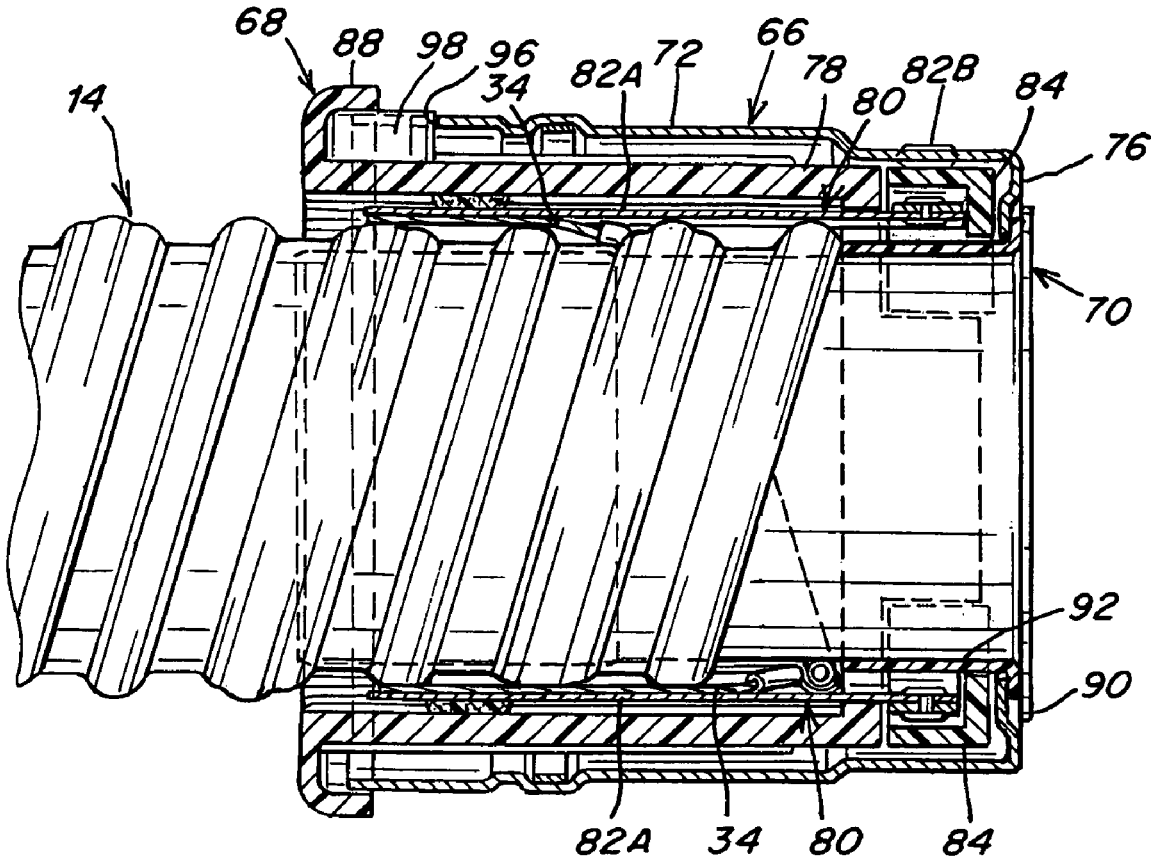
FIG. 15 is a cross-sectional side view of the final assembly of the hose adapter terminating a hose in accordance with the invention.
Figures 16, 17:
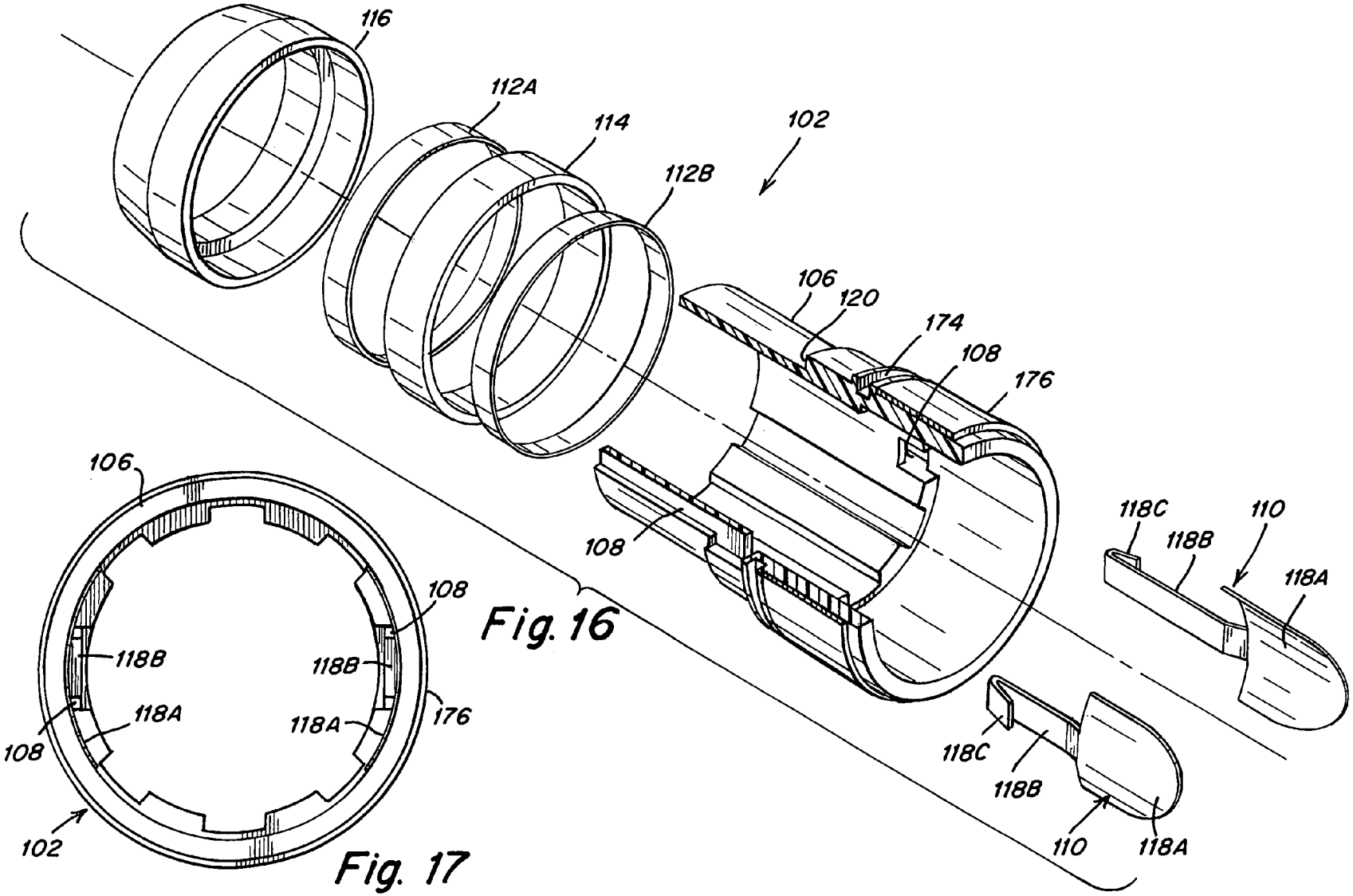
FIG. 16 is an exploded perspective view of part of a hose adapter for connecting a hose to a handle assembly.
FIG. 17 is a proximal end view of the assembly adapter parts shown in FIG. 16.
Figure 18:
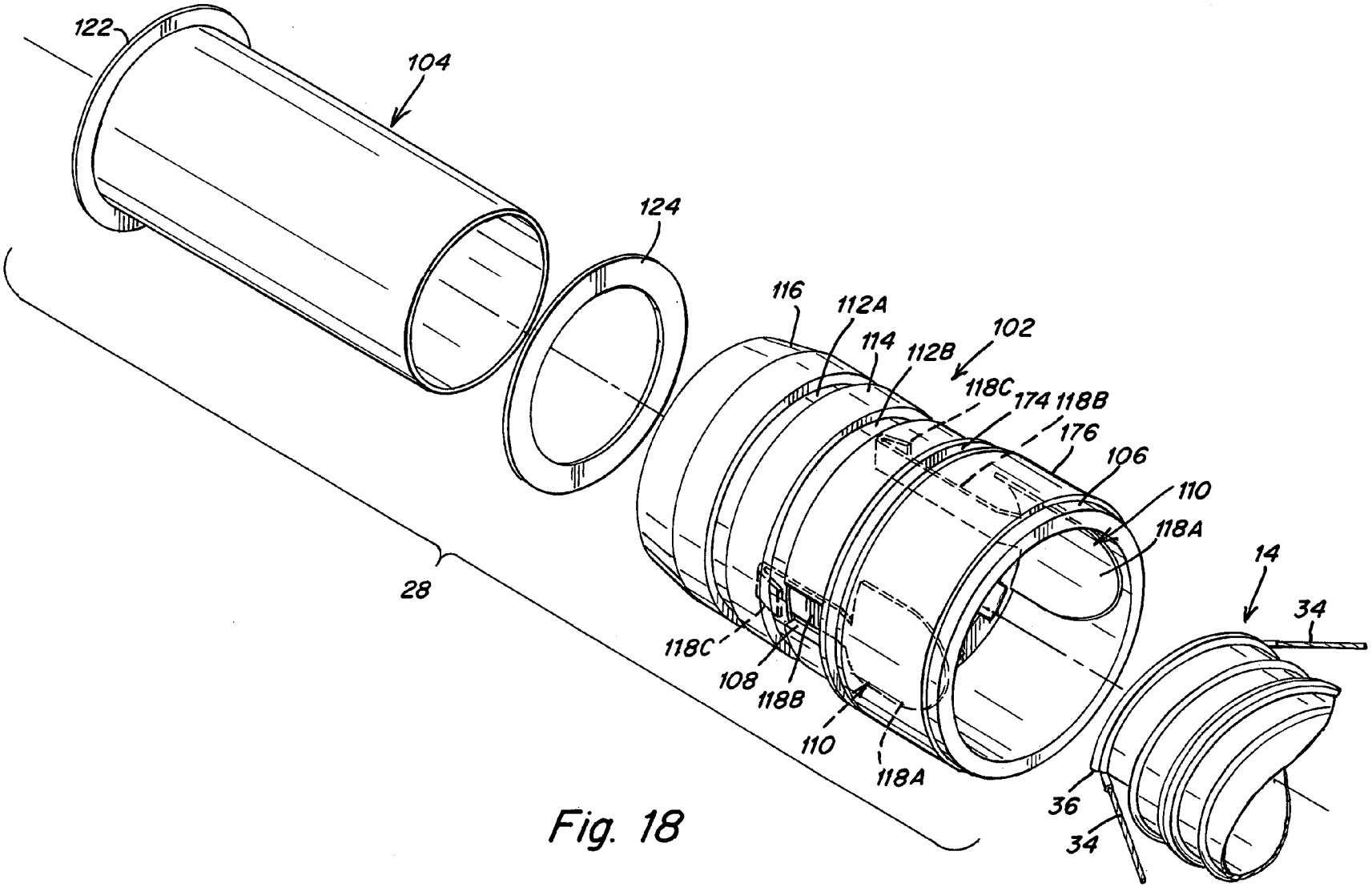
FIG. 18 is an exploded perspective view of a partially assembly adapter shown in FIG. 16 with a hose.

Annealing ring 70 is then inserted into the front end of the outer sleeve 66 until the lip 90 contacts lip 76 formed on the outer sleeve 66 (see FIG. 15). The assembly is then inserted into an annealing device which applies a force outward from an interior of the annealing ring 70 to cause a rear portion of the annealing ring 70 to expand and press the hose 14 against the hose engagement sleeve 68.

The hose 14 is thereby secured to the adapter 26' and the exposed conductive parts of the wires 34 are firmly pressed against the arcuate portions 82A of the electrodes 80 (see FIG. 15). Thus, electrical connection between the wires 34 in the hose 14 and the electrodes 80 is provided. Power to operate the power nozzle 18 can therefore be provided from the housing 12 to and through the hose 14 via the connection between the contact portions 82B of the electrodes 80 and contacts in the housing 12 and the connection between the arcuate portions 82A of the electrodes 80 and the wires 34. Plastic ring 92 serves to isolate the conductive annealing ring 70 from the arcuate portions 82A of the electrodes 80.

Adapter 28, used to connect the hose 14 to the handle assembly 16, is shown by itself in FIGS. 16–20 and in combination with handle assembly 16 in FIGS. 21–26.

Adapter 28 comprises a sleeve 102 and an annealing ring 104 insertable into a front end of the sleeve 102. The contour of the sleeve 102 has a form enabling it to be inserted into a cavity 136 defined at a rear of the handle assembly 16, additional details of which are provided below.

Sleeve 102 includes a substantially tubular body 106 made of a dielectric material and defining a pair of axially extending grooves 108, a pair of electrodes 110, electrical contact rings 112A, 112B arranged around the tubular body 106 and insulator sleeves 114, 116 arranged around the tubular body 106. Electrodes 110 each have a flat, arcuate portion 118A arranged against the inner surface of the tubular body 106, an axially extending intermediate portion 118B extending through a passageway defined in part by a respective groove 108 and a contact portion 118C adapted to contact with a respective contact ring 112A, 112B. To provide good electrical contact between the contact portions 118C and the contact rings 112A, 112B, the contact portions 118C extend upward and rearward from the intermediate portions 118B to provide the contact portions 118C with resiliency so that when the contact rings 112A, 112B engage the contact portions 118C, they urge the contact portions 118C inward against their bias. As a result, a force maintaining the contact portions 118C in contact with the contact rings 112A, 112B is provided.

Contact rings 112A, 112B are arranged around the tubular body 106, each in contact with a contact portion 118C of a respective electrode 110, and electrically insulated from one another by insulator sleeve 114. Tubular body 106 is provided with a forward-facing step 120 to position the rearmost contact ring 112B in a position in which it engages the contact portion 118C of one of the electrodes 110. The insulator sleeve 114 has an axial length designed to position the forwardmost contact ring 112A in a position in which it engages the contact portion 118C of the other electrode 110.

Insulator sleeve 116 is situated at the forward end of the tubular body 106 and is tapered inward to facilitate insertion of the adapter 28 into the cavity 136 in the handle assembly 16. An optional reinforcing ring 176 is arranged around the tubular body 106.

Annealing ring 104 is substantially cylindrical and includes a small lip 122 at a front edge. Annealing ring 104 is made of a material capable of being annealed or deformed, the purpose of which is explained below.

To assemble adapter 28 in connection with hose 14 to form a hose assembly, one end of the hose 14 is cut to provide a free length of the wires 34 and the insulation on this free length of the wires 34 is then cut to expose the electrically conductive material thereof. The hose 14 is then positioned in connection with sleeve 102 with the exposed conductive part of the wires 34 being placed in contact with or opposite the arcuate portions 118A of the electrodes 110. This can be facilitated by viewing the position of the arcuate portions 118A through the open front end of the sleeve 102.

Figure 19:
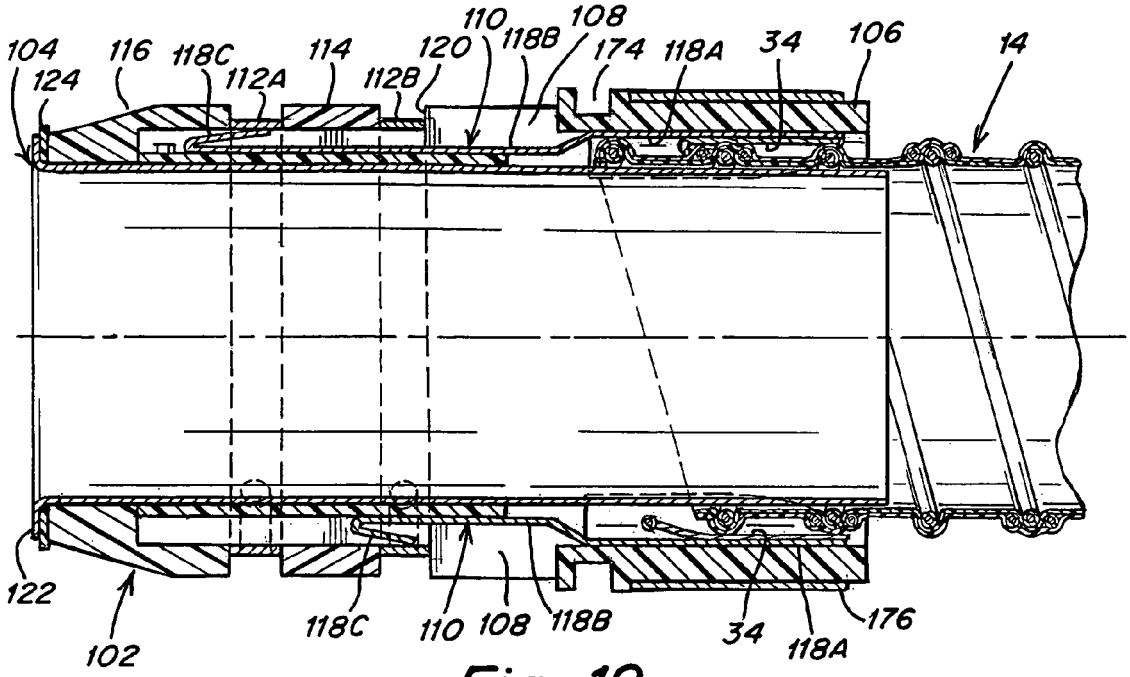
FIG. 19 is a cross-sectional side view of the assembled adapter shown in FIG. 16 with the hose.
Figure 20:
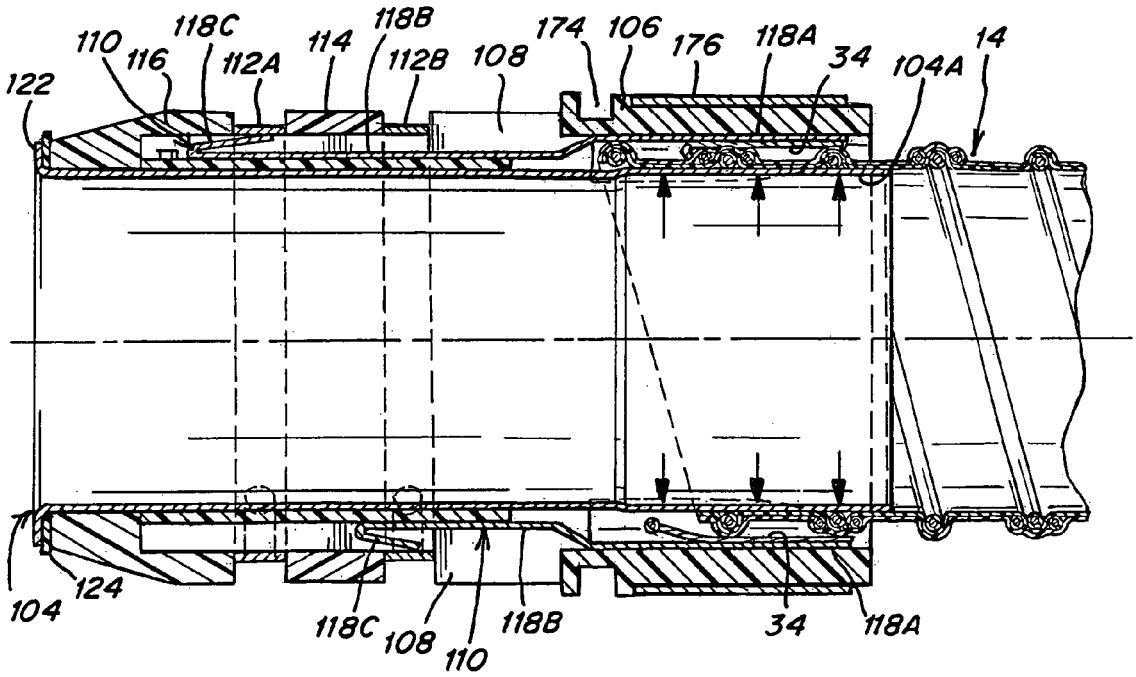
FIG. 20 is a cross-sectional side view similar to FIG. 19 but showing the expansion of a section of the internal metal tube.
Figure 21:
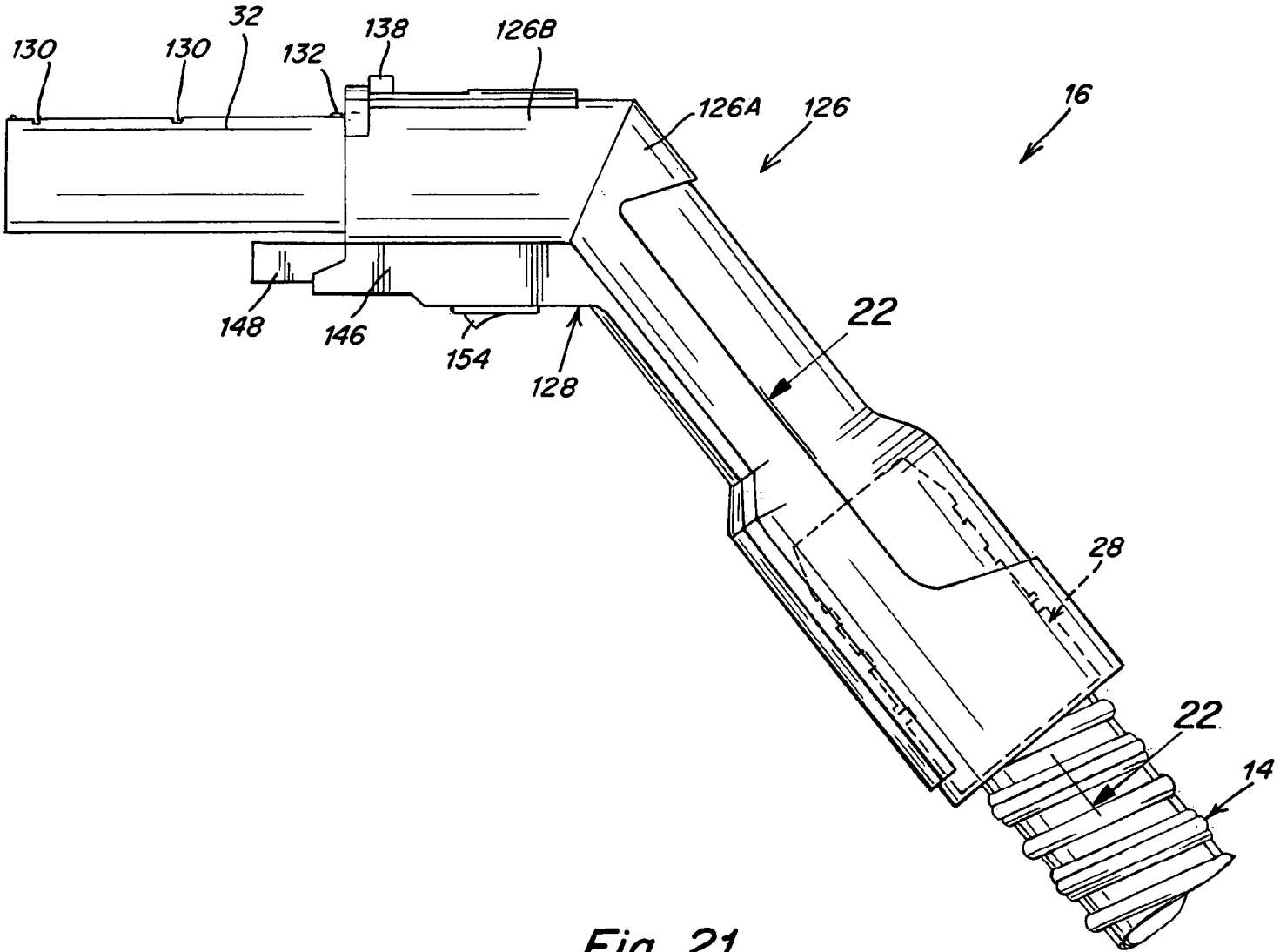
FIG. 21 is a side view of a handle assembly connected via an adapter to a hose.

Annealing ring 104 is then inserted into the front end of the sleeve 102 until a vacuum-sealing ring 124 arranged against the lip 122 contacts insulator sleeve 116 (see FIGS. 19 and 20). Vacuum sealing ring 124 is designed to seal an air flow passage through the handle assembly 16 when the adapter 28 is situated in the cavity 136 in the handle assembly 16. The assembly is then inserted into an annealing device which applies a force outward from an interior of the annealing ring 104 to cause a rear portion of the annealing ring 104 to expand and press the hose 14 against the sleeve 102 (this rear portion being designated 104A in FIG. 20).

The hose 14 is thereby secured to the adapter 28 and the exposed conductive parts of the wires 34 are firmly pressed against the arcuate portions 118A of the electrodes 110 (see FIG. 20). Thus, electrical connection between the wires 34 in the hose 14 and the electrodes 110 is provided. Power to operate the power nozzle 18 can therefore be transferred from the hose 14 (to which it is provided via adapter 26 or 261 from the housing 12) to electrodes 110 and, via contact rings 112A, 112B electrically connected to electrodes 110, to the handle assembly 16, as discussed below.

Referring now to FIGS. 21–26, the handle assembly 16 in accordance with the invention provides a support member for the user of the vacuum cleaner 10 to grasp while vacuuming. Handle assembly 16 generally comprises a handle portion 126 having a substantially tubular hand-gripping portion 126A and a substantially tubular wand engaging portion 126B, the metal tube 32 extending from the wand engaging portion 126B of the handle portion 126 and an interconnection housing 128 which is attached to the handle portion 126.

Metal tube 32 includes one or more indentations or openings 130 and a protuberance 132 adjacent the wand-engaging portion 126B of the handle portion 126. Indentations or openings 130 mate with a cooperating structure on the adapter 30, discussed in more detail below, while protuberance 132 is effective to prevent rotation of the adapter 30 relative to the handle assembly 16 when mated therewith.

Handle portion 126 is preferably made of a plastic material (ABS) and is generally of a bent tubular shape. The forward end of the handle portion 126, i.e., the wand-engaging portion 126B, receives the metal tube 32, which may be secured within the wand-engaging portion 126B by riveting. Alternatively, the metal tube 32 may be bonded to the wand-engaging portion 126B and a rivet can be used to strengthen the bonded interconnection.

Handle portion 126 defines an air flow passage 134 and includes the cavity 136 at a rear portion, i.e., in the hand-gripping portion 126A, for receiving adapter 28 and which communicates with the air flow passage 134. A slidable air throttle control 138 is provided on the handle portion 126 for selectively opening and closing an opening in the metal tube 32 leading to the air flow passage 134.

Figure 24:
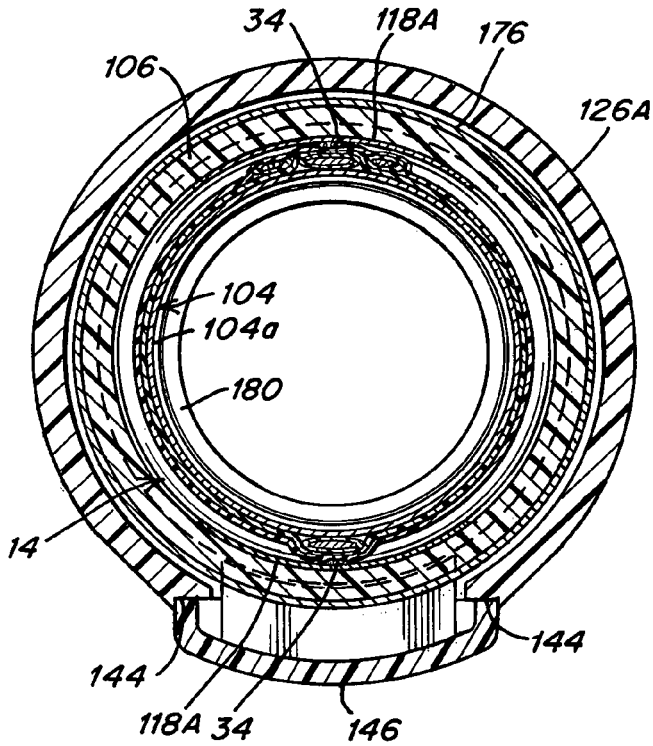
FIG. 24 is a cross-sectional end view taken along the line 24—24 in FIG. 23.
Figure 25:
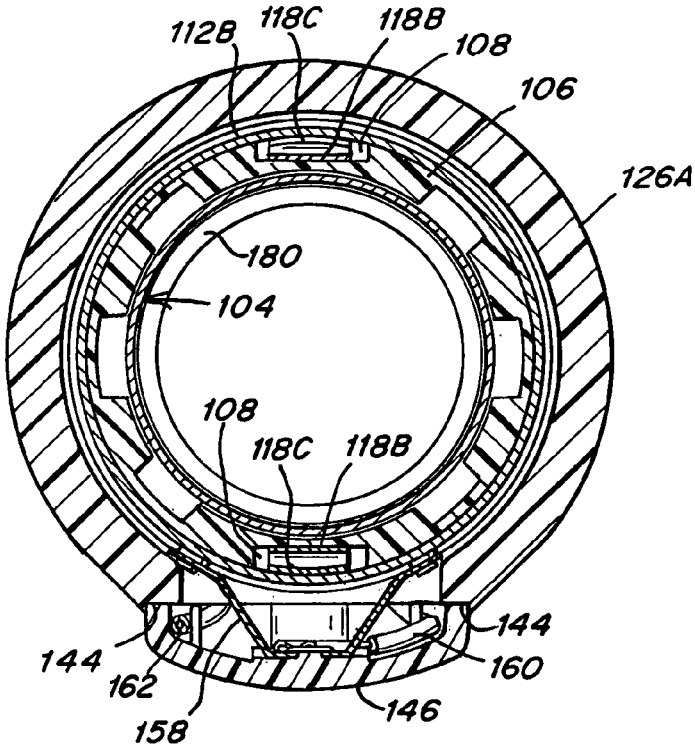
FIG. 25 is a cross-sectional end view taken along the line 25—25 of FIG. 23.
Figure 26:
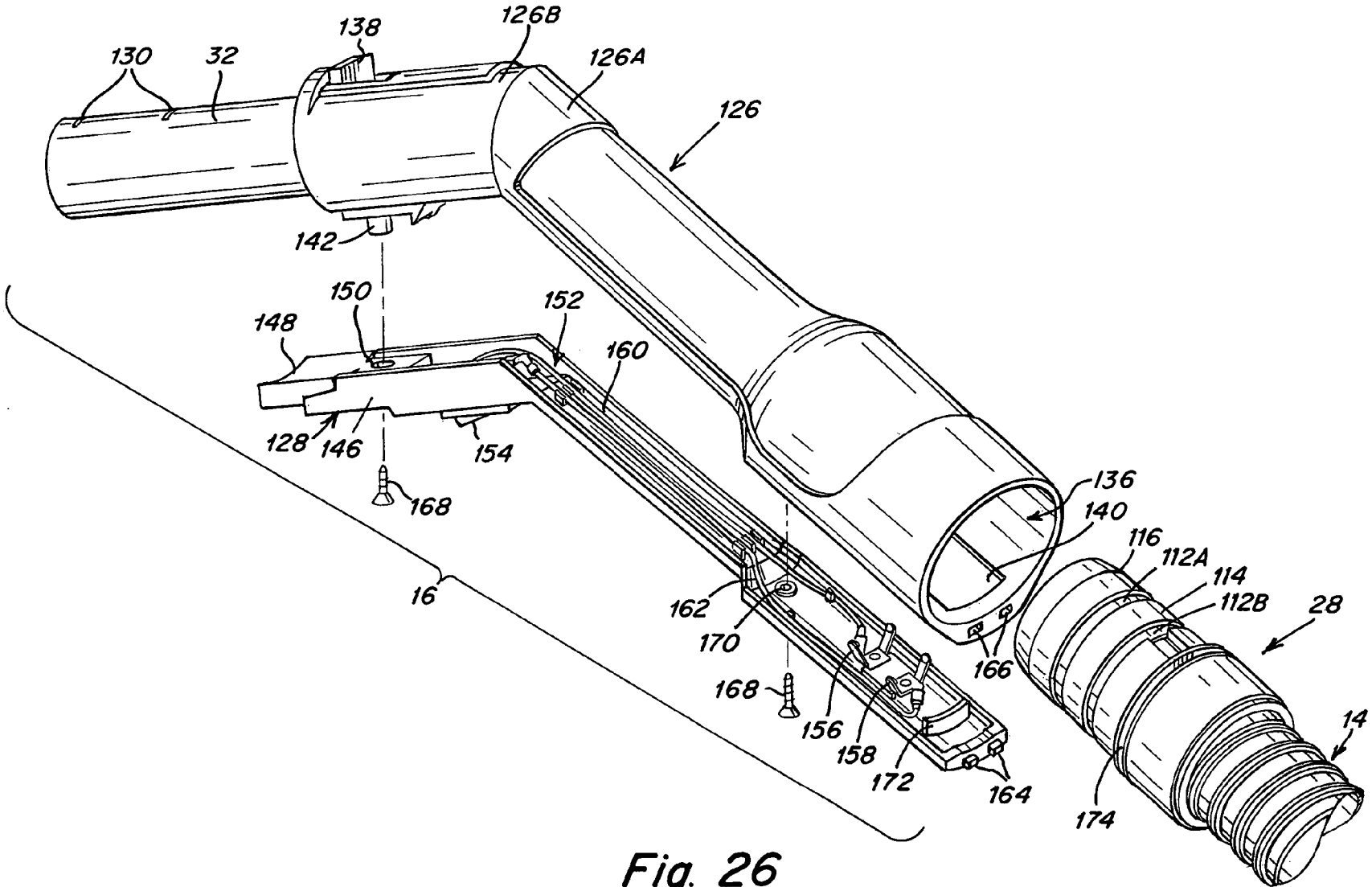
FIG. 26 is an exploded perspective view of the handle assembly and adapter shown in FIG. 21.
Figure 27:
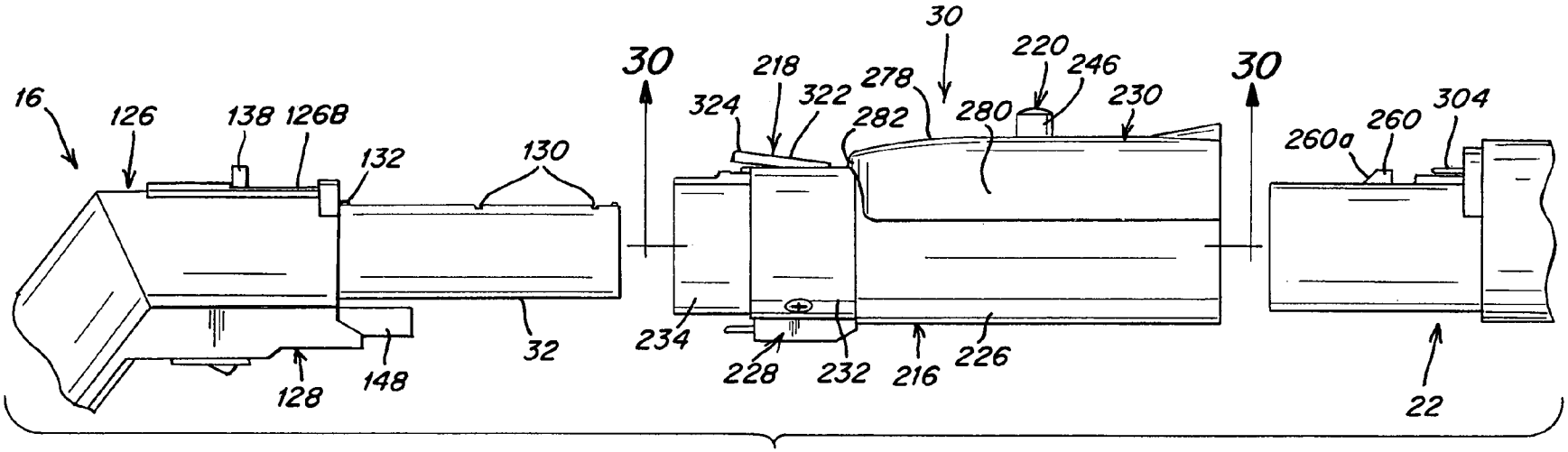
FIG. 27 is an exploded side view of a vacuum cleaner wand adapter according to the present invention for coupling a wand implement to a handle of a vacuum cleaner.
Figure 29:
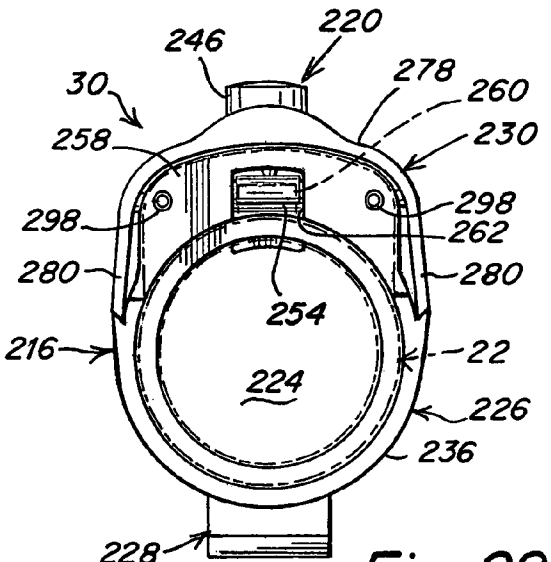
FIG. 29 is a front elevational view of the wand adapter of FIG. 27.

Handle portion 126 also includes a slot 140 leading to cavity 136 and mounting projections 142 and mounting grooves 144 which enable the interconnection member 128 to be attached in a predetermined position to the handle portion 126. While the mounting grooves 144 extend substantially coextensive with the lateral edges of the interconnection member 128, only a portion of the mounting grooves 144 is shown in FIGS. 24 and 25. Projections 142 are designed to receive screws 168 which pass through apertures 170 in the interconnection housing 128, as described below (see FIG. 26).

Figure 22:
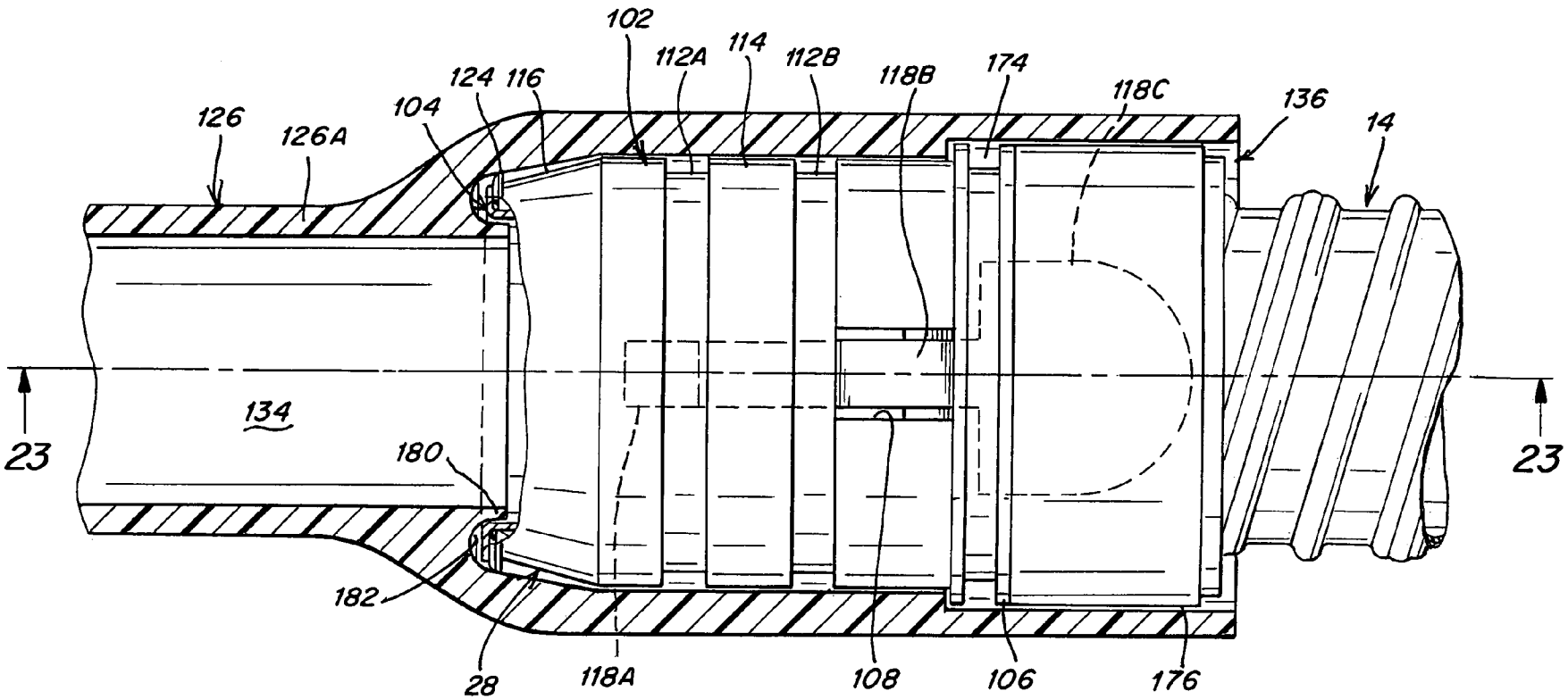
FIG. 22 is a cross-sectional plan view of the handle assembly and adapter shown in FIG. 16 taken along the line 22—22 of FIG. 21.
Figure 23:
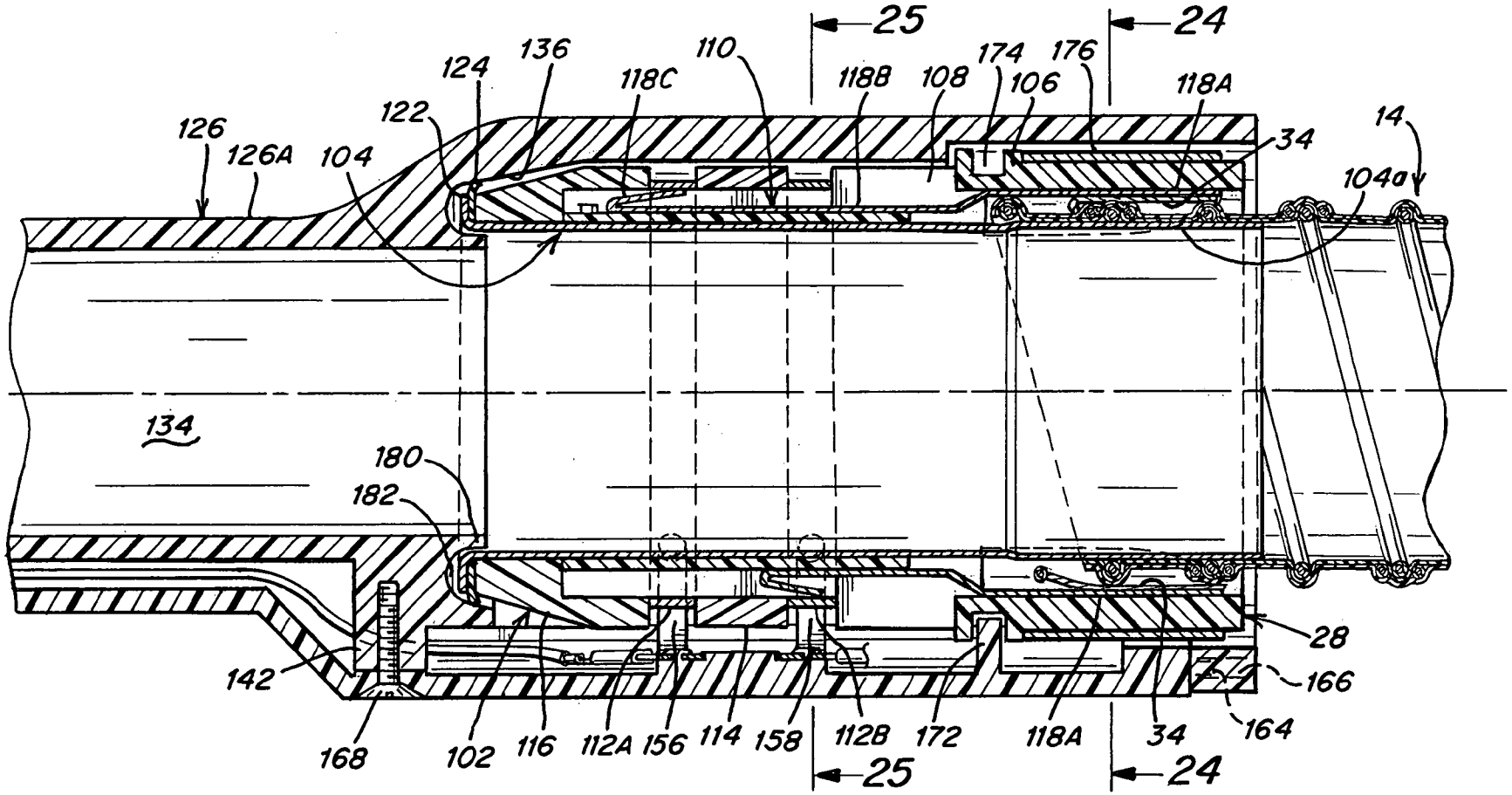
FIG. 23 is a cross-sectional side view of the handle assembly and adapter shown in FIG. 21 taken along the line 23—23 in FIG. 22.

An interior flange 180 is formed in the handle portion 126 to receive the front edge of the adapter 28 (see FIGS. 22 and 23). The lip 122 of the annealing ring 104 enters into an annular groove 182 formed on the flange 180 when the adapter 28 is mated with the handle assembly 16. The vacuum-sealing ring 124 is designed to reduce and preferably close an annular gap between the front end of the adapter 28 and the inner surface of the handle portion 126 (as shown in FIGS. 22 and 23) to maintain the vacuum pressure in the air flow passage 134.

Interconnection housing 128 includes an angled base member 146, a coupling member 148 at an upper portion having electrified female plugs embedded therein and an aperture 150 designed to accommodate one of the mounting projections 142 on the handle portion 126, and an electrical interconnection system 152 for electrically connecting the plugs to the contact rings 112A, 112B on the adapter 28. The plugs are designed to receive male contacts on wand adapter 30.

Electrical interconnection system 152 includes a switch 154, a pair of contacts 156, 158, each designed to engage with a respective one of the contact rings 112A, 112B, a wire 160 connecting one contact 156 to one of the plug receptacles, another wire 162 connecting the other contact 158 to switch 154 and another wire connecting the switch 154 to the other plug receptacle (not shown). Contacts 156, 158 are mounted to the base member 146 and each has a pair of upwardly extending contact portions (see FIG. 26). Contacts 156, 158 may be connected to the wires 160, 162 using spade terminals. A circuit is formed between the switch 154, the contacts 156, 158 and the plug receptacles so that when the switch 154 is depressed to an operational position, current flows between the plug receptacles and the contact rings 112A, 112B.

To connect the interconnection member 128 to the handle portion 126 to form handle assembly 16, a pair of projections 164 formed on the base member 146 are placed into slots 166 in the handle portion 126, the coupling member 148 is positioned such that its aperture 150 receives a projection 142 and the edges of the base member 146 are then urged into grooves 144. Screws 168 are then inserted through apertures 170 in the base member 146 into projections 142.

Adapter 28 is typically inserted into the cavity 136 prior to connection of interconnection member 128 to handle portion 126. To aid in maintaining adapter 28 in position relative to the handle portion 126, an arcuate locking finger or ridge 172 is formed on the underside of the base member 146 and is accommodated in an annular locking groove 174 formed on the adapter 28 (see FIG. 23).

To disconnect the hose 14 from the handle assembly 16, screws 168 are removed, base member 146 is lifted off of handle portion 126 until the locking ridge 172 is out of the locking groove 174 and then the hose 14 is pulled away from the handle portion 126 causing the adapter 28 to be removed from the cavity 136.

Referring now to FIGS. 27–41, wand adapter 30 in accordance with the invention for coupling the handle portion 126 of the handle assembly 16 to wand assembly 20, specifically the metal tube 32 to the wand portion 22, generally comprises a housing 216, a locking mechanism 218 arranged on the housing 216 for releasably locking the metal tube 32 to the housing 216, and a locking mechanism 220 arranged on the housing 216 for releasably locking the housing 216 to the wand portion 22. Housing 216 defines an inner through passage 224 whereby during use of the adapter 30, the wand portion 22 is situated in a front end of the passage 224 and the end of the metal tube 32 enters into a rear end of the passage 224 (see FIG. 30). A suction passage is thereby formed from the wand portion 22, through the passage 224 in the housing 216 to the air flow passage 134 in the handle assembly 16, and debris and particulate matter picked up by the wand assembly 20 or power nozzle 18 connected thereto are drawn through this suction passage into the vacuum cleaner housing 12.

Figure 33:
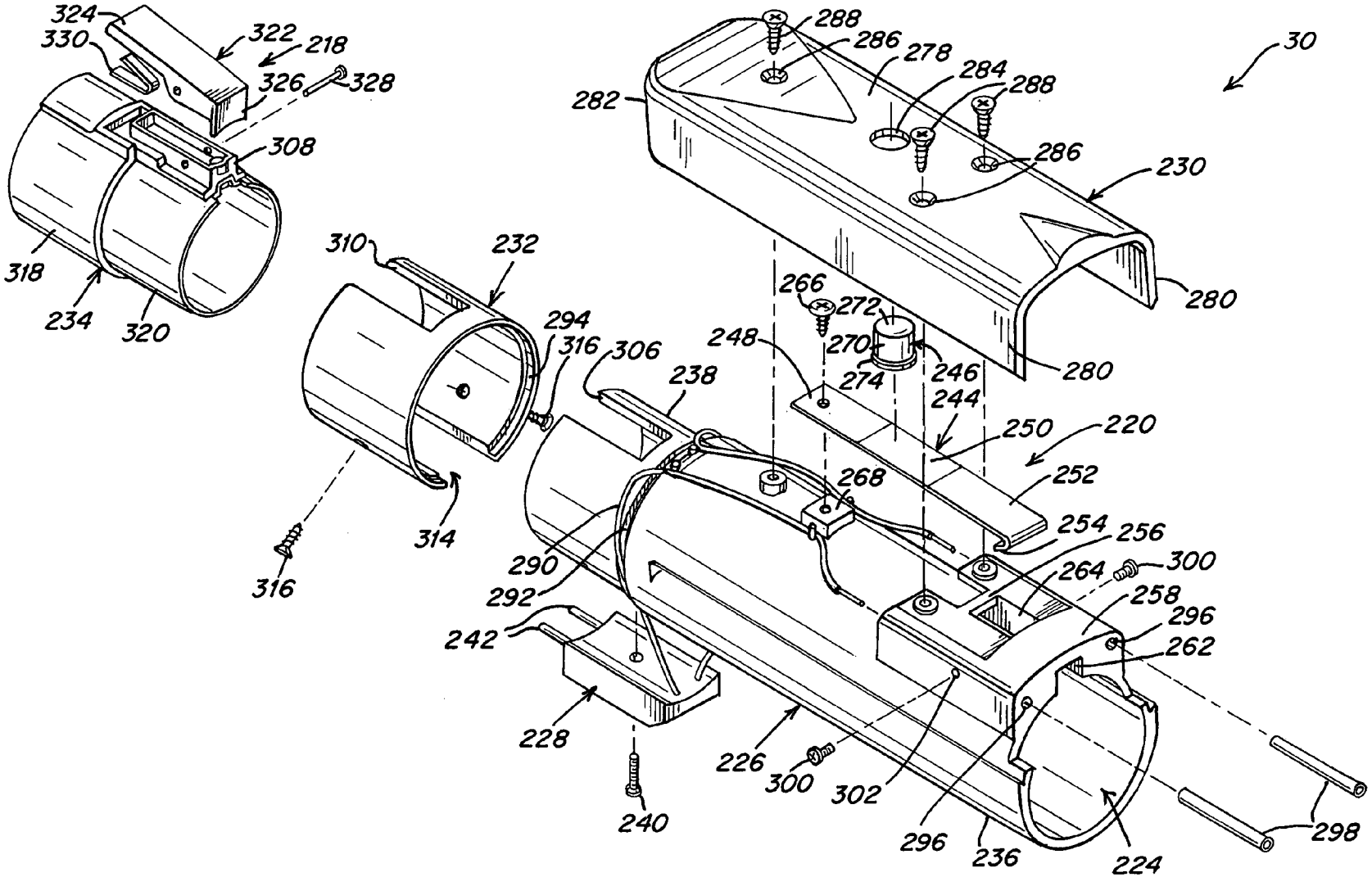
FIG. 33 is an exploded view of the wand adapter of FIG. 27.
Figure 34:
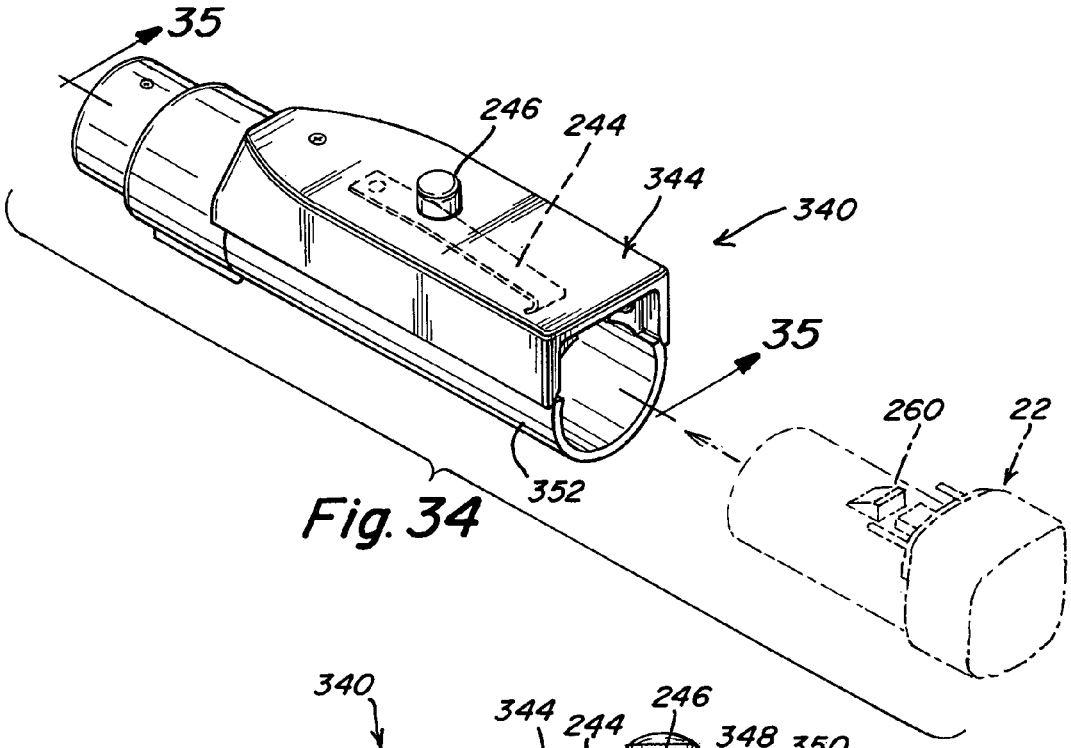
FIG. 34 is a perspective view of another embodiment of a wand adapter according to the present invention.
Figure 35:
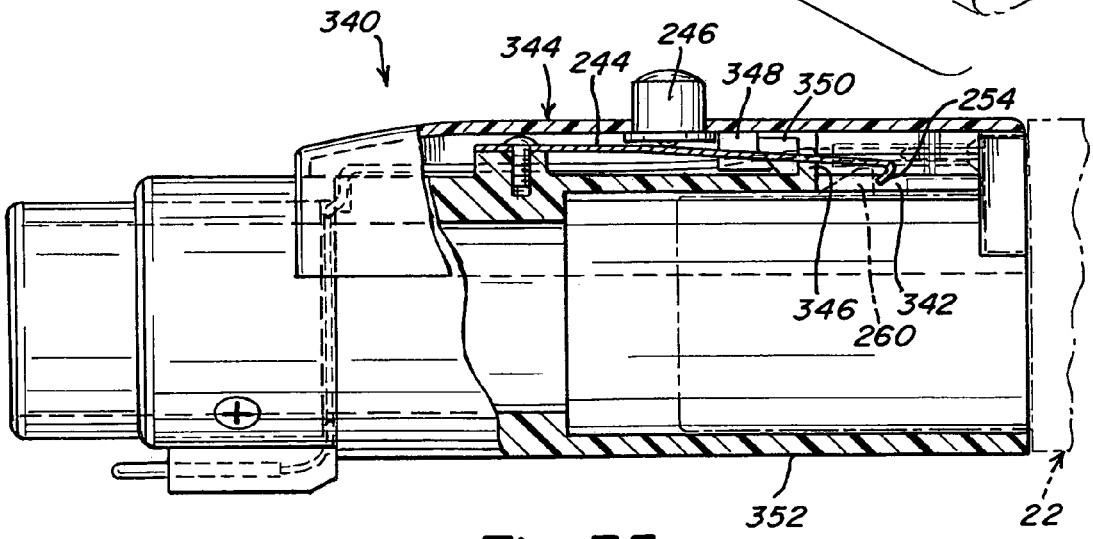
FIG. 35 is a side elevational view of the wand adapter of FIG. 34 when coupled to a wand implement (shown in phantom lines) and partially broken away to show internal structure.
Figure 36:
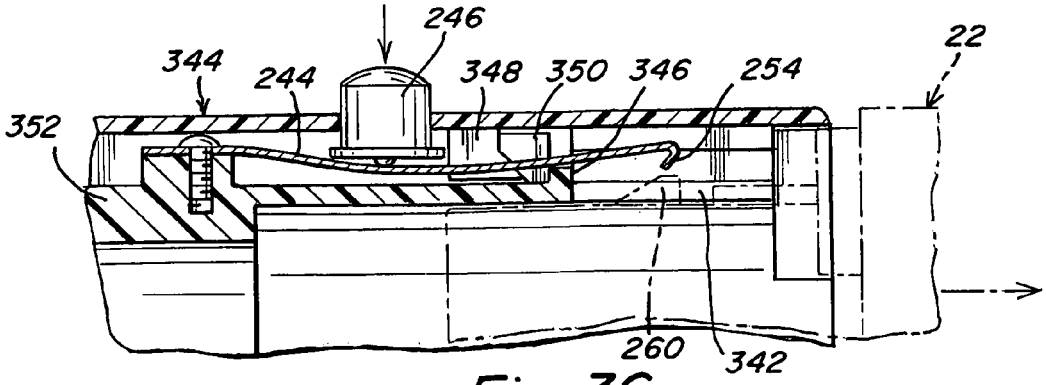
FIG. 36 is a sectional view of the wand adapter of FIG. 34.
Figure 37:
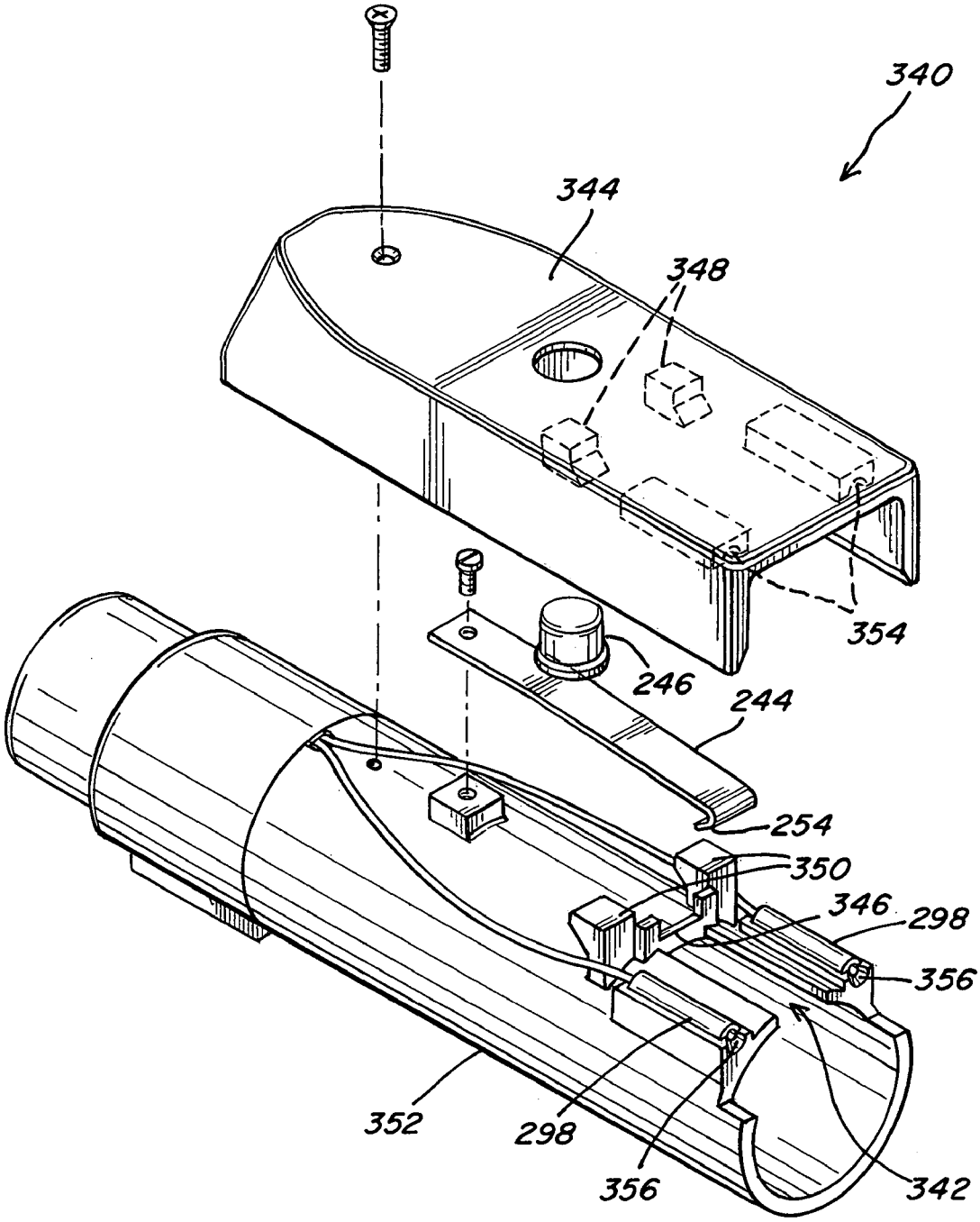
FIG. 37 is an exploded view of the wand adapter of FIG. 34.
Figure 38:
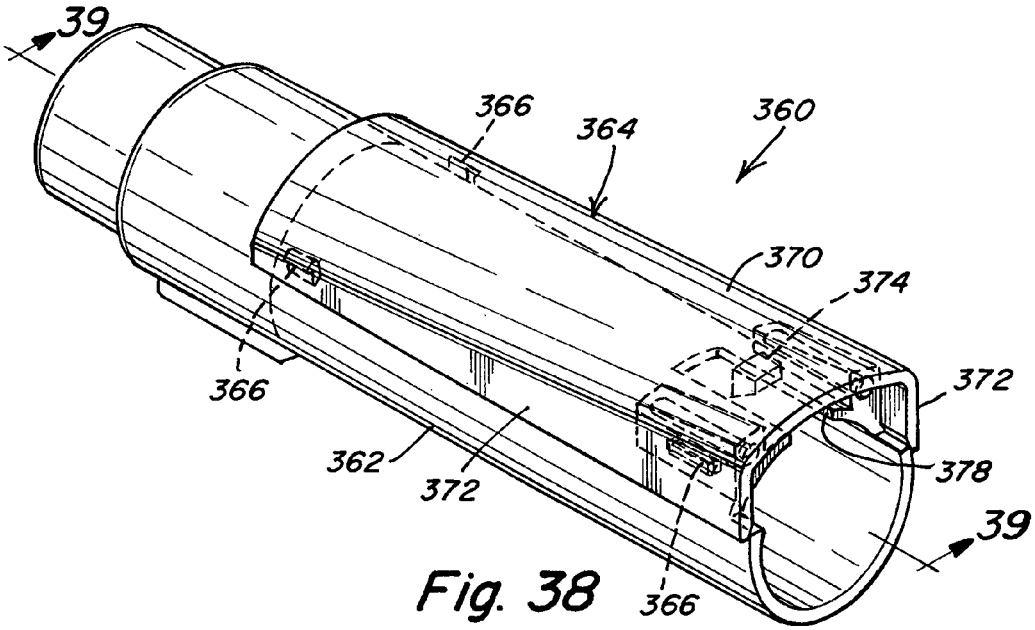
FIG. 38 is a perspective view of another embodiment of a wand adapter according to the present invention.
Figure 39:
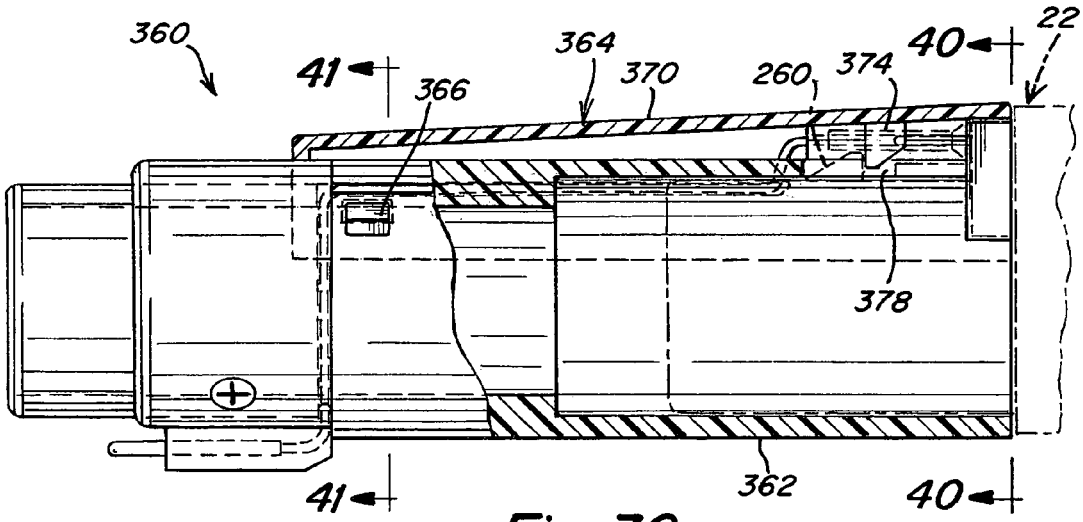
FIG. 39 is a side elevational view of the wand adapter of FIG. 38 when coupled to a wand implement (shown in phantom lines) and partially broken away to show internal structure.
Figure 40:
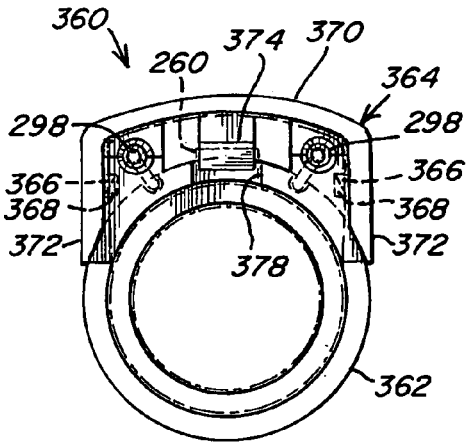
FIG. 40 is a sectional view taken along the line 40—40 in FIG. 39.
Figure 41:
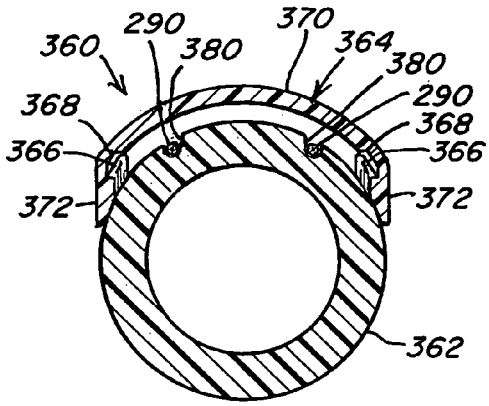
FIG. 41 is a sectional view taken along the line 41—41 in FIG. 39.

Referring to FIG. 33, housing 216 includes a substantially tubular member 226 on which an electrical connector 228 is arranged, a shroud or cover 230 removably connected to the member 226 and partially enclosing the locking mechanism 220 when connected to the member 226, a C-shaped wire-retaining member 232 and a locking part 234 having the locking mechanism 218 arranged thereon.

Member 226 has a first substantially tubular portion 236 situated at the front of the member 226 and a second substantially tubular portion 238 having a smaller diameter than the first tubular portion 236 and situated at the rear of the member 226. Connector 228 is attached via a screw 240 to the outer surface of second tubular portion 238 such that electrical contacts thereof, i.e., metal prongs 242, extend rearward. Prongs 242 have a shape and size to enable interconnection with female plug receptacles on the handle assembly 16, i.e., the plug receptacles on the coupling member 148 of the interconnection member 128. Prongs 242 may be provided with different shapes and sizes to be compatible with different manufacturers=vacuum cleaner handles.

Locking mechanism 220 comprises a thin, elongate leaf spring clip or member 244 and a release button 246 arranged to actuate the leaf spring member 244. The leaf spring member 244 is biased to urge the button 246 against an inner surface of the cover 230, upward in the illustrated embodiment.

Leaf spring member 244 has an attachment portion 248 at one end at which the leaf spring member 244 is attached to the tubular member 226, a locking portion 252 arranged at the opposite end and an actuating portion 250 arranged between the attachment portion 248 and locking portion 252. Locking portion 252 has a rearward facing hook 254 arranged at the end thereof (see FIG. 33). Actuating portion 250 may be slightly angled relative to attachment portion 248 and the planar part of the hook 254 may also be angled slightly relative to the actuating portion 250.

Locking portion 252 passes over and rests on a support ledge 256 formed on a coupling part 258 of the tubular member 226. Support ledge 256 constitutes a fulcrum designed so that downward pressure applied to the actuating portion 250, namely by depressing the button 246, causes rotational movement of the locking portion 252 about the support ledge 256 with the hook 254 being pivoted upward away from the passage 224.

Figure 30:
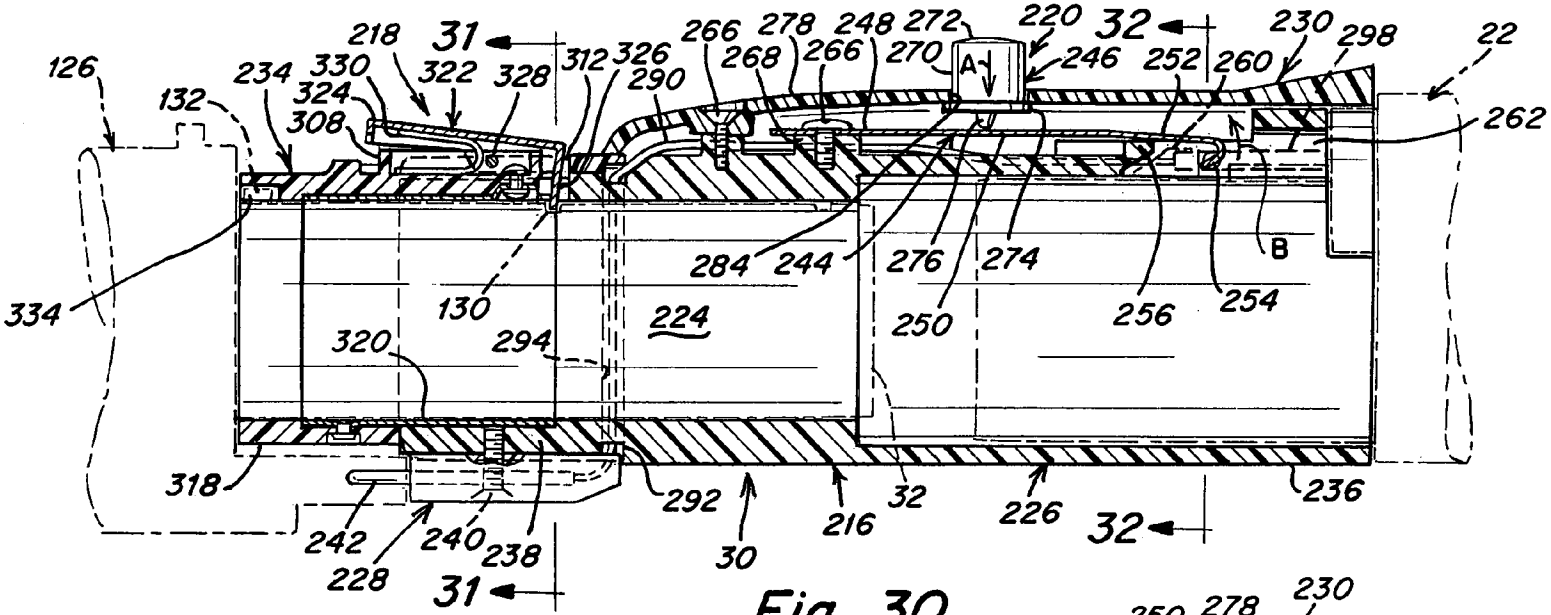
FIG. 30 is a sectional view taken along the line 30—30 in FIG. 27.
Figure 32:
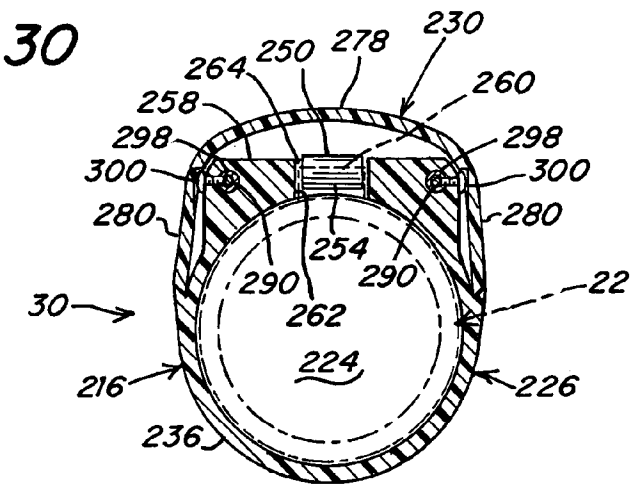
FIG. 32 is a sectional view taken along the line 32—32 in FIG. 30.

Hook 254 is designed to hook around a projecting block 260 formed on the wand portion 22 to prevent unintentional separation of the adapter 30 from the wand portion 22 and thereby secure the adapter 30 to the wand portion 22 (see FIG. 30). Projecting block 260 has an upwardly inclined surface 260*a* facing the rear end of the wand portion 22 which enables a front edge of the hook 254 to slide along the surface 260*a* and pass over the projecting block 260 during attachment of the adapter 30 to the wand portion 22. To facilitate engagement of the hook 254 beyond the projecting block 260 during attachment of the adapter 30 to the wand portion 22, the coupling part 258 is provided with a longitudinally extending slot 262 having a width sufficient to accommodate the projecting block 260 and an opening 264 communicating with the slot 262 and situated to enable the hook 254 to engage the projecting block 260 once the adapter 30 is slid onto the wand portion 22 a sufficient distance to ensure secure coupling thereto.

Attachment portion 248 of the leaf spring member 244 is attached to the tubular member 226 by an appropriate attachment mechanism, such as by a screw 266 passing through an aperture in the leaf spring member 244 and into an aperture in a screw engagement part 268 of the tubular member 226. Other mechanisms for securing the attachment portion 248 of the leaf spring member 244 to the tubular member 226 are also possible within the scope and spirit of the invention.

Button 246 has a substantially cylindrical portion 270, a rounded upper surface 272, a lower rim 274 projecting beyond the periphery of the cylindrical portion 270 and a protuberance 276 on a lower surface. Preferably, button 246 is positioned so that protuberance 276 engages the actuating portion 250 of the leaf spring member 244 (see FIG. 30).

Button 246 actuates the leaf spring member 244 to enable separation of the adapter 30 from the wand portion 22 in that by depressing the button 246 in the direction of arrow A in FIG. 30, the actuating portion 250 is caused to move downward resulting in rotation of the locking portion 252 about the support ledge 256 (in the direction of arrow B) and the hook 254 to be raised above the projecting block 260. The adapter 30 and wand portion 22 are then separable from one another by pulling them apart.

Cover 230 includes an upper wall 278, side walls 280 and a front wall 282. Cover 230 engages with the tubular member 226 such that the side walls 280 are positioned alongside the sides of the coupling part 258 and the upper wall 278 substantially overlies the leaf spring member 244 (see FIG. 32). An aperture 284 is formed in the upper wall 278 through which the cylindrical portion 270 of the button 246 passes. Button 246 is retained in position in view of the lower rim 274 being provided with a larger circumference than the aperture 284. Additional apertures 286 are formed in the upper wall 278 to enable screws 288 to pass therethrough into engagement with threaded receptacles formed in the tubular member 226 and/or coupling part 258 thereof.

Referring again to FIG. 33, wires 290 are connected to the prongs 242 and pass through complementary wire channels 292, 294 defined by the member 226 and wire-retaining member 232, respectively, and then over the outer surface of first tubular portion 236 to the coupling part 258.

Coupling part 258 includes a pair of bores or through channels 296 into which the wires 290 pass from a rear opening. Tubular electrical contacts 298 are arranged in the channels 296. Contacts 298 are electrically connected to the wires 290 by arranging the wires 290 inside the tubular contacts 298 and tightening clamping screws 300, which are threaded into threaded holes 302 in the coupling part 258, to thereby clamp ends of the wires 290 inside the tubular contacts 298 while at the same time fixing the tubular contacts 298 in the channels 296. Wires 290 can be guided in their passage over the outer surface of the first tubular portion 236, for example, by attaching them to the screw engagement part 268 formed on the outer surface (FIG. 33).

The ends of the wires 290 extend only partially through the interior of the contacts 298 to leave a front portion of the interior of the contacts 298 open. This allows electrical contacts, such as metal prongs 304 of the wand assembly 20, to enter into the interior of and contact the contacts 298 when the adapter 30 is connected to the wand assembly 20. An electrical path between the prongs 304 of the wand assembly 20 and the prongs 242 of connector 228 is thereby formed via the contacts 298 and wires 290.

The channels 296 are spaced apart a set distance in order to align with the prongs 304 of existing vacuum cleaner housings. In this manner, the adapter 30 can be coupled to existing wand implements.

At the opposite end of the housing 216 from locking mechanism 220, structure is provided to accommodate the metal tube 32 of the handle portion 126 of the handle assembly 16 and locking mechanism 218. Specifically, the second tubular portion 238 of the tubular member 226 includes an axially extending slot 306 which receives a mounting projection 308 of the locking part 234 (see FIG. 33). Retaining member 232 defines the wire channels 294 at a rear edge and also defines an axially extending slot 310 extending from the front edge in alignment with the slot 306 in the tubular member 226. Slots 306, 310 are sized relative to the mounting projection 308 to provide an opening 312 between the mounting projection 308 and the end of the slots 306, 310, the purpose of which is described below (see FIG. 30).

Figure 31:
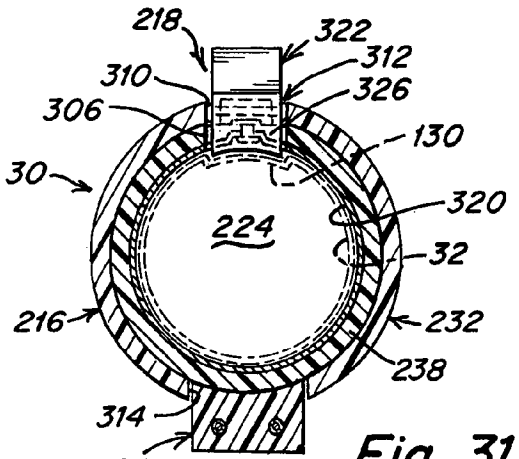
FIG. 31 is a sectional view taken along the line 31—31 in FIG. 30.

Retaining member 232 also includes an axially extending through channel 314 which accommodates connector 228 (see FIG. 31). Retaining member 232 is attached to the first tubular portion 36 of the tubular member 226 by tightening screws 316 which pass through apertures in the retaining member 232 into engagement with the tubular member 226 (see FIG. 33). Screws 316 pass through the tubular member 226 into contact with the locking part 234 to secure the locking part 234 in connection with the tubular member 226.

Locking part 234 includes first and second tubular portions 318, 320 connected together, e.g., via a rivet, and with the second tubular portion 320 having a smaller diameter than the first tubular portion 318 to enable it to fit inside the second tubular portion 238 of the tubular member 226 (see FIG. 30). Mounting projection 308 is formed primarily on the second tubular portion 320. The second tubular portion 320 may be made of a metal.

Locking mechanism 218 includes a release catch 322 having a pressure-application portion 324 at one end and an inwardly extending catch 326 at an opposite end, and is pivotally mounted to the mounting projection 308 at a central region by means of a pivot pin 328 (see FIGS. 30 and 33). Locking mechanism 218 also includes a leaf spring 330 arranged within the mounting projection 308 and between the pressure application portion 324 and the outer surface of the second tubular portion 320. Leaf spring 330 biases the pressure-application portion 324 upward and thus the catch 326 downward to pass through opening 312 into the passage 224 (see FIG. 30).

Catch 326 is designed to pass into or through one of the indentations or openings 130 in the swaged metal tube 32 of the handle portion 126 of the handle assembly 16 to thereby secure the adapter 30 in connection with the handle assembly 16 (see FIG. 30). As such, to attach the handle assembly 16 to the adapter 30, pressure is applied to the pressure-application portion 324 of the release catch 322 causing the catch 326 to be moved upward and then the handle assembly 16 is urged into the locking part 234. Pressure on the pressure-application portion 324 is released when the catch 326 is aligned with one of the indentations or openings 130 so that the catch 326 moves into the aligning indentation or opening 130 and fixes the handle assembly 16 to the adapter 30. Unintentional separation of the handle assembly 16 from the adapter 30 is thereby prevented since pressure must once again be applied to the pressure-application portion 324 of the release catch 322 to cause the catch 326 to be moved out of the indentation or opening 130. A secure attachment of the handle assembly 16 to the adapter 30 is therefore provided.

Figure 28:
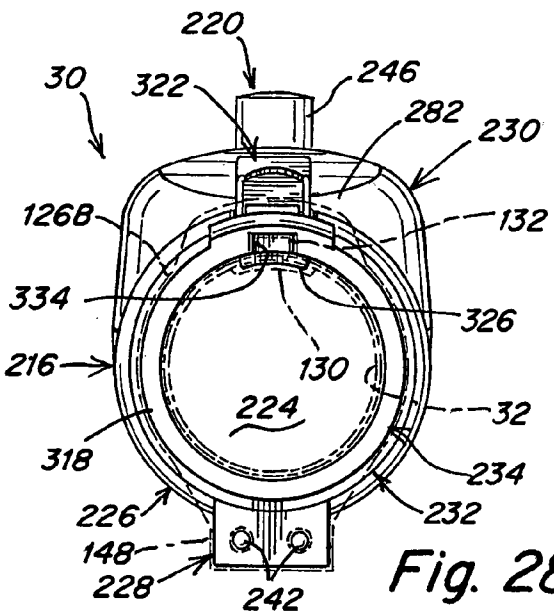
FIG. 28 is a rear elevational view of the wand adapter of FIG. 27.

To aid alignment of the adapter 30 with the handle assembly 16, a slot 334 is formed on an inner surface of the locking part 234 to align with the protuberance 132 formed on the metal tube 32 of the handle assembly 16 when the adapter 30 is properly positioned relative to the handle assembly 16 (see FIGS. 28 and 30).

Assembly of the housing 216 involves, in no particular order and non-exclusive, attaching the leaf spring member 244 to the tubular member 226, placing the contacts 298 into the threaded holes 302, attaching the connector 228 to the tubular member 226, guiding the wires 290 along the wire channels 292 into the contacts 298, tightening the screws 300 to secure the wires 290 in engagement with the contacts 298, positioning the button 246 over the leaf spring member 244, attaching the cover 230 to the tubular member 226, attaching the retaining member 232 to the tubular member 226, attaching the release catch 322 to the mounting projection 308 of the locking part 234 and sliding the locking part 234 into engagement with the tubular member 226. The adapter 30 is now ready to be coupled to the handle assembly 16 and the wand assembly 20.

Referring now to FIGS. 34–37, another embodiment of a vacuum cleaner wand adapter in accordance with the invention is designated generally as 340. Adapter 340 is similar to or can include similar parts as adapter 30, even if such parts as not shown, e.g., a locking mechanism for releasably locking the adapter 340 to a handle assembly is not shown but can be the same as locking mechanism 218 described above. Adapter 340 can be used for interconnecting a handle assembly to a wand implement of a vacuum cleaner.

Differing from adapter 30, adapter 340 includes an axially extending slot 342 opening at a front end and which is covered only by the cover 344, a support ledge 346 behind the slot 342 on which the leaf spring member 244 is supported and cooperating positioning and engagement members 348, 350 on the cover 344 and tubular member 352 to secure the cover 344 to the tubular member 352. In addition, tubular contacts 298 are arranged between contact-receiving channels 354, 356 formed on each of the cover 344 and tubular member 352.

Another wand adapter in accordance with the invention designated 360 is shown in FIGS. 38–41 and can be used for interconnecting a handle to a wand implement. Adapter 360 is similar to or can include similar parts as adapters 30, 340, even if such parts as not shown, e.g., a locking mechanism for releasably locking the adapter 360 to a handle is not shown but can be the same as locking mechanism 218 described above.

One particular difference between adapter 360 and adapters 30, 340 is that adapter 360 requires removal of a cover member in order to separate the adapter 30 from the wand implement in view of the absence of a releasable locking mechanism.

Adapter 360 generally comprises a substantially tubular member 362 and a cover 364 detachably connected to the member 362 by a cooperating fastening arrangement. Tubular member 362 includes integral fastening members 366 such as snap fits for enabling the cover 364 to be removably fastened to the tubular member 362. Two pair of fastening members 366 are arranged to engage complementary recesses 368 formed on the underside of the cover 364, one pair at a front of the cover and the other pair at a rear thereof (see FIG. 41). Recesses 368 are formed at the corner between a curved upper wall 370 and substantially planar side walls 372 of the cover 364.

Cover 364 includes a lug 374 projecting on the lower surface of the upper wall 370 and having an inclined surface facing an end of the adapter 360. Lug 374 is designed to contact and pass over a projecting block 260 formed on the wand portion 22 to which the adapter 360 is coupled to thereby secure the adapter 360 thereto (see FIG. 39). Projecting block 260 has an upwardly inclined surface which enables the lug 374 to pass along the surface and over the projecting block 260 (the cover 364 is slightly flexible to allow for the movement of the lug 374 over the projecting block 260). To facilitate engagement of the adapter 360 to the wand portion 22, the tubular member 362 includes an axially extending slot 378 having a width sufficient to accommodate the projecting block 260. Unintentional separation of the adapter 360 from the wand portion 22 is prevented in view of the placement of the lug 374 beyond the projecting block 260 and the cooperating fastening arrangement between the tubular member 362 and the cover 364.

In this embodiment, instead of guiding the wires 290 over the outer surface of the tubular member as in the embodiment shown in FIGS. 27–33, grooves 380 are formed in an outer surface of the tubular member 362 and the wires 290 are positioned or embedded in the grooves 380. This feature can be incorporated into the other embodiments of the invention disclosed herein.

As noted above, since a releasable locking mechanism is not provided, it is not possible to easily separate the adapter 360 from the wand portion 22 it is attached to. Nevertheless, separation of the adapter 360 from the wand portion 22 is still possible by lifting the side walls 372 of the cover 364 in order to disengage the fastening members 366 from the recesses 368. Upon disengagement, the cover 364 is lifted off of the tubular member 362 and thus, the adapter 360 can be separated from the wand portion 22.

A handle assembly for a vacuum cleaner in accordance with the invention can be constructed to include any of adapters 30, 340, 360 described above and a handle having a metal end designed to mate with the adapter. A wand assembly for a vacuum cleaner in accordance with the invention can be constructed to include any of the adapters 30, 340, 360 described above and a wand portion 22 designed to mate with the adapter. Such a handle or wand assembly would be easy to manufacture and conceivably be capable of use in vacuum cleaners of different manufacturers. A vacuum cleaner assembly could also be constructed in accordance with the invention to include any of the adapters 30, 340, 360 described above, a handle having a metal end designed to mate with the adapter at one end and a wand portion designed to mate with the adapter at its other end.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. An adapter for connecting a vacuum cleaner canister housing to a vacuum cleaner hose including a pair of wires, comprising:

an outer sleeve adapted to mate with the canister housing and including electrodes through which electricity is transferred from the canister housing to the wires in the hose;

a hose engagement sleeve arranged at least partially in said outer sleeve and positioning the wires of the hose in alignment with said electrodes; and an annealing ring arranged at least partially in said hose engagement sleeve such that a space is provided between said hose engagement sleeve and said annealing ring in which the hose is situated and when said annealing ring is annealed, the wires are held in contact with said electrodes.

2. The adapter of claim 1, wherein said electrodes each include an arcuate portion arranged against an inner surface of said outer sleeve, each wire being in contact with a respective one of said arcuate portions.

3. The adapter of claim 1, wherein said hose engagement sleeve includes a substantially tubular body having a pair of wire guide notches in which the wires of the hose are positioned.

4. A hose assembly, comprising:

an elongate hose including a pair of wires; and the adapter of claim 1 arranged at one end of said hose, each of said wires being arranged in contact with a respective one of said electrodes.

5. The hose assembly of claim 4, wherein said electrodes each include an arcuate portion arranged against an inner surface of said outer sleeve, each of said wires being in contact with a respective one of said arcuate portions.

6. The hose assembly of claim 4, wherein said hose engagement sleeve includes a substantially tubular body having a pair of wire guide notches, each of said wires being positioned in a respective one of said wire guide notches.

7. An adapter for connecting a vacuum cleaner canister housing to a vacuum cleaner hose including a pair of wires, comprising:

an outer sleeve adapted to mate with the canister housing;

a hose engagement sleeve arranged at least partially in said outer sleeve and including electrodes through which electricity is transferred from the canister housing to the wires in the hose; and an annealing ring arranged at least partially in said hose engagement sleeve such that a space is provided between said hose engagement sleeve and said annealing ring in which the hose is situated and when said annealing ring is annealed, the wires are held in contact with said electrodes.

8. The adapter of claim 7, wherein said outer sleeve has a substantially tubular body and spring-loaded engagement members arranged on said body for enabling said outer sleeve to be releasably inserted into a port on the canister housing.

9. The adapter of claim 7, wherein said outer sleeve includes an inwardly directed lip at the front end which contacts said annealing ring.

10. The adapter of claim 7, wherein said hose engagement sleeve has a substantially tubular body, each of said electrodes including an exposed flat, arcuate portion arranged against an inner surface of said tubular body and a contact portion projecting outward from said tubular body, said arcuate portions of said electrodes providing contact surfaces for the wires of the hose.

11. The adapter of claim 10, wherein said tubular body includes contact-receiving members each of which covers a forward part of a respective one of said arcuate portions and through which a respective one of said contact portions extend, said arcuate portions being attached at a rear end to the inner surface of said tubular body to provide an anchor region and enable said contact-receiving members and covered part of said electrodes to be inwardly flexible.

12. A hose assembly, comprising:

an elongate hose including a pair of wires; and the adapter of claim 7 arranged at one end of said hose, each of said wires being arranged in contact with a respective one of said electrodes.

13. The hose assembly of claim 12, wherein said outer sleeve has a substantially tubular body and spring-loaded engagement members arranged on said body for enabling said outer sleeve to be releasably inserted into a port on the canister housing.

14. The hose assembly of claim 12, wherein said outer sleeve includes an inwardly directed lip at the front end which contacts said annealing ring.

15. The hose assembly of claim 12, wherein said hose engagement sleeve has a substantially tubular body, each of said electrodes including an exposed flat, arcuate portion arranged against an inner surface of said tubular body and a contact portion projecting outward from said tubular body, said wires being arranged in contact with said arcuate portions of said electrodes.

16. The hose assembly of claim 15, wherein said tubular body includes contact-receiving members each of which covers a forward part of a respective one of said arcuate portions and through which a respective one of said contact portions extend, said arcuate portions being attached at a rear end to the inner surface of said tubular body to provide an anchor region and enable said contact-receiving members and covered part of said electrodes to be inwardly flexible.

17. An adapter for connecting a handle assembly for a vacuum cleaner to a vacuum cleaner hose including a pair of wires, comprising:

a sleeve having a contour enabling it to be insertable into a cavity defined by the handle assembly, said sleeve including a substantially tubular body defining a pair of axially extending grooves, a pair of electrodes each extending along a respective one of said grooves and having an exposed portion and electrical contact rings arranged around said tubular body and each in electrical engagement with a respective one of said electrodes; and an annealing ring arranged in a front end of said sleeve such that a space is provided between said exposed portion of said electrodes and said annealing ring in which the hose is situated and when said annealing ring is annealed, the wires are held in contact with said electrodes.

18. The adapter of claim 17, wherein said sleeve further comprises a first insulator ring arranged between said contact rings and a second insulator ring arranged at a front of said sleeve.

19. The adapter of claim 17, wherein said electrodes each include a flat, arcuate portion arranged against an inner surface of said tubular body, an axially extending intermediate portion extending through a passageway defined in part by a respective one of said grooves and a contact portion arranged in contact with a respective one of said contact rings.

20. The adapter of claim 17, wherein said tubular body comprises an annular locking groove adapted to receive a locking finger formed on the handle assembly.

21. A hose assembly, comprising:

an elongate hose including a pair of wires; and the adapter of claim 17 arranged at one end of said hose, each of said wires having an exposed portion arranged in contact with said exposed portion of a respective one of said electrodes.

22. The hose assembly of claim 21, further comprising an additional adapter arranged at the opposite end of said hose, said additional adapter comprising:

an outer sleeve adapted to mate with a canister housing and including electrodes through which electricity is transferred from the canister housing to said wires in said hose;

a hose engagement sleeve arranged at least partially in said outer sleeve and positioning the wires of the hose in alignment with said electrodes; and an annealing ring arranged at least partially in said hose engagement sleeve such that a space is provided between said hose engagement sleeve and said annealing ring in which the hose is situated and when said annealing ring is annealed, the wires are held in contact with said electrodes.

23. The hose assembly of claim 21, further comprising an additional adapter arranged at the opposite end of said hose, said additional adapter comprising:

an outer sleeve adapted to mate with the canister housing;

a hose engagement sleeve arranged at least partially in said outer sleeve and including electrodes through which electricity is transferred from the canister housing to the wires in the hose; and an annealing ring arranged at least partially in said hose engagement sleeve such that a space is provided between said hose engagement sleeve and said annealing ring in which the hose is situated and when said annealing ring is annealed, the wires are held in contact with said electrodes.

* * * * *